US012631414B2

(12) United States Patent
Vitulli

(10) Patent No.: US 12,631,414 B2
(45) Date of Patent: May 19, 2026

(54) GUN MAGAZINE INCLUDING SPRING WITH UNEVEN STACK HEIGHT UPON COMPRESSION

(71) Applicant: Brandon Vitulli, Thomasville, GA (US)

(72) Inventor: Brandon Vitulli, Thomasville, GA (US)

( * ) Notice: Subject to any disclaimer, the term of this patent is extended or adjusted under 35 U.S.C. 154(b) by 0 days.

(21) Appl. No.: 18/884,263

(22) Filed: Sep. 13, 2024

(65) Prior Publication Data

US 2025/0003708 A1 Jan. 2, 2025

Related U.S. Application Data

(63) Continuation-in-part of application No. 18/118,952, filed on Mar. 8, 2023, now Pat. No. 12,241,711.

(51) Int. Cl.
*F41A 9/70* (2006.01)
*F41A 9/69* (2006.01)

(52) U.S. Cl.
CPC . *F41A 9/70* (2013.01); *F41A 9/69* (2013.01)

(58) Field of Classification Search
None
See application file for complete search history.

(56) References Cited

U.S. PATENT DOCUMENTS

2023/0266084 A1* 8/2023 Oaks ..... F41A 9/70 42/50

* cited by examiner

*Primary Examiner* — Reginald S Tillman, Jr.

(57) ABSTRACT

A gun magazine spring and magazine assembly having a novel design. The coils of the spring are configured to nest in certain regions and overlap in others. The result is that—as the spring nears its fully compressed state—the spring has an uneven stack height from left to right. The uneven stack height produces a predictable lateral displacement of the follower. The higher of the two stacked sides of the spring protrudes laterally outward through a lateral relief in the follower. This feature allows the spring and follower to overlap in the vertical direction to a greater extent than would be possible with conventional laterally-even spring nesting. The additional overlap produces additional internal space while also ensuring that the spring and follower assembly behave in a predictable manner.

14 Claims, 23 Drawing Sheets

GUN MAGAZINE INCLUDING SPRING WITH UNEVEN STACK HEIGHT UPON COMPRESSION

CROSS-REFERENCES TO RELATED APPLICATIONS

The present application is a continuation-in-part of U.S. patent application Ser. No. 18/118,952. The parent application was filed on Mar. 8, 2023. It listed the same inventors.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of firearms. More specifically, the invention comprises a magazine having a magazine spring with an uneven compressed spring height left to right. The uneven stack height provides a reduced overall height for a spring and follower assembly nearing the spring's maximum compression.

2. Description of the Related Art

It is important to maximize space efficiency in detachable firearm magazines. This is particularly true for pistol magazines—where the magazine must fit inside the pistol's grip and therefore be encircled by the user's hand. Firearms manufacturers provide a fixed volume for the external dimensions of the magazine. The magazine must conform to this fixed volume in order to fit into the firearm. Thus, the external dimensions of a magazine intended for use in a particular firearm are essentially fixed.

The magazine's internal dimensions may vary somewhat, but these are constrained by the cartridge the magazine is designed to house. The magazine tube wall thickness and the cartridge diameter will largely fix the internal magazine width (width being perpendicular to the pistol bore) and internal length (length being parallel to the pistol bore). The internal height is also largely constrained since the top of the magazine tube (incorporating the cartridge feed lips and rails) must rest in a fixed position and the bottom of the magazine tube must also rest in a fixed position (often proximate the base of the pistol grip but sometimes below it for extended magazines). Thus, a magazine designer is constrained as to the internal dimensions as well.

A magazine is intended to (1) reliably feed the cartridges it houses while (2) containing a desired number of cartridges when fully loaded. As those skilled in the art will know, the cartridges within the magazine are forced upward by a magazine spring acting on a follower. The magazine spring is compressed between the base of the magazine tube and the follower. The follower bears against the cartridges and urges them upward toward the cartridge feed lips and rails.

The follower is urged downward—and the magazine spring is compressed—as more cartridges are loaded into the magazine. The number of cartridges that can be loaded is usually limited by the magazine spring reaching a fully compressed state and arresting the further downward motion of the follower. Significant effort has been directed to the design of followers and magazine springs in order to minimize the fully compressed height of the spring/follower assembly (thereby maximizing cartridge capacity). An example of this prior artwork is described in U.S. Pat. No. 4,397,453 to Seecamp (1983). In the Seecamp design, successive coils in the magazine spring are nested so that multiple coils can collapse into the height of a single coil. This reduces the fully compressed height of the magazine spring.

An additional prior art example is described in U.S. Publication No. 2023/0266084 to Oaks et.al (assigned to Sig Sauer, Inc.). The Oaks publication teaches a magazine spring with multiple nesting coils. These coils are designed to nest symmetrically, so that the overall height of the stack on the right side of the magazine is the same as the overall height of the stack on the left side of the magazine (see FIGS. 2A and 2B of the Oaks disclosure).

A magazine spring in general must exert a suitable upward-biasing force on the follower throughout the full range of the follower's travel. This objective presents a challenge, since the follower will often travel more than two-thirds of the overall height of the magazine tube. The magazine spring should be stable in compression throughout this range. This is particularly challenging for "double stack" magazines, where the lower portion of the magazine tube contains two parallel (and somewhat overlapping) columns of cartridges and the upper portion tapers to a single column. When the magazine spring nears its fully compressed state in a double stack magazine, it is desirable for the spring to compress in a predictable way. The present invention provides such a design.

BRIEF SUMMARY OF THE PRESENT INVENTION

The present invention comprises a gun magazine spring and magazine assembly having a novel design. The coils of the spring are configured to nest in certain regions and overlap in others. The result is that—as the spring nears its fully compressed state—the spring has an uneven stack height from left to right. The uneven stack height produces a predictable lateral displacement of the follower. The higher of the two stacked sides of the spring protrudes laterally outward through a lateral relief in the follower. This feature allows the spring and follower to overlap in the vertical direction to a greater extent than would be possible with conventional laterally-even spring nesting. The additional overlap produces additional internal space while also ensuring that the spring and follower assembly behave in a predictable manner.

REFERENCE NUMERALS IN THE DRAWINGS

Figure 1:
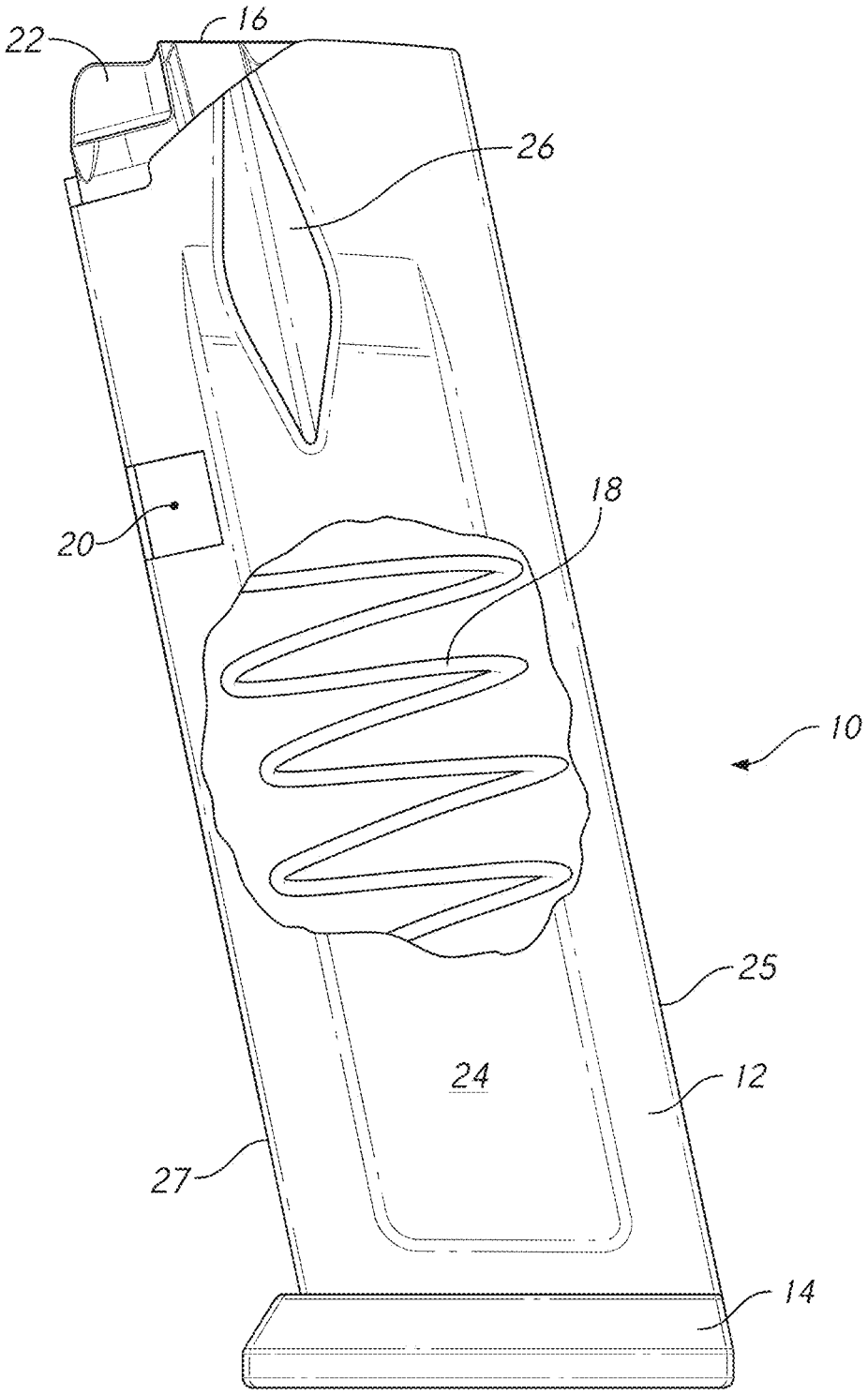
FIG. 1 is a side elevation view with a cutaway, showing an embodiment of the present invention.

10 magazine assembly
12 tube
14 base
16 follower
18 spring
20 magazine latch relief
22 slide latch relief
24 indentation
25 rearward wall
26 angled indentation
27 forward wall
28 double stack region
29 sloping indentation
30 transition region
32 feed relief
34 feed lip
36 plate
38 protrusion
40 opening
42 cavity
44 lateral flange
46 longitudinal slot
50 rearward portion
52 forward portion
74 left notch
76 right notch
78 forward skirt
80 rearward skirt
82 curved cradle
84 ridge
86 chamfer
88 spring receiver cavity
90 forward boss
92 rearward boss
102 central lateral relief
112 vertical plane
120 lower end
122 upper end
124 lower plane
128 upper plane
130 spring base centerline
132 upper coil centerline
134 left wall
136 right wall
138 asymmetric stack height region

DETAILED DESCRIPTION OF THE INVENTION

The following descriptions pertain to preferred embodiments of the present invention. Having reviewed these descriptions, many more embodiments will occur to those skilled in the art. Accordingly, the scope of the invention should be set by the claims presented at the end of this disclosure rather than the embodiments described.

The invention is well-suited to "double stack" magazines, in which at least a portion of the magazine houses two overlapping columns of cartridges. FIG. 1 provides a side elevation view of such a magazine assembly 10. This disclosure uses a directional convention (upper, lower, forward, rearward, etc.) that is based on the firearm. The assumption is that the firearm's barrel is held in a horizontal position with the opening configured to receive the inventive magazine facing downward (so that the magazine is loaded into the magazine well by moving it generally upward). "Forward" is toward the muzzle and "rearward" is the opposite. "Left" is the left side of the firearm and "right" is the opposite. "Width" refers to a measurement taken in a direction that is horizontal and perpendicular to the barrel. "Length" refers to a measurement taken in a direction that is parallel to the barrel. The orientation shown in FIG. 1 is the orientation in which a magazine will typically be used. The firearm into which the magazine is inserted—in this case a pistol—is normally held and fired upright with the magazine well being contained within a grip the user holds.

Tube 12 provides the main structure of the magazine assembly. The term "tube" is conventional in the industry, even though the structure is not round. The tube is typically a thin-walled hollow structure, open at the top and bottom. Rearward wall 27 is generally perpendicular to the tube's side walls. Forward wall 25 is more rounded. Left and right side walls are generally planar. The reader should note that the four walls of the tube can in fact be one continuous wall without distinct corners or other features of demarcation.

Base 14 can be any structure that is attached to the lower portion of the tube 12. It is preferable for the base to provide gripping features that facilitate the quick removal of the magazine. In the example of FIG. 1, base 14 includes an expanding section that is easily grasped.

Follower 16 slides up and down within the hollow interior of tube 12. The upper portion of the tube tapers inward. The very top portion of the tube preferably includes a pair of feed lips/rails (Some magazines incorporate a pair of rearward feed lips and a pair of forward feed rails. Pistol magazines, such as the one shown, often combine these features). The feed lips/rails properly locate a cartridge being fed by the magazine so that a moving pistol slide will "strip" a fresh cartridge off the top of the magazine each time the firearm cycles. Follower 16 is sized so that it cannot escape through the feed lips/rails and out the top of the tube. The follower is thus captured within the tube. When the last cartridge is moved out of the magazine, follower 16 will be arrested in its fully raised position—which is shown in FIG. 1.

FIG. 1 includes a cutaway through the side wall facing the viewer. Spring 18 rests within the tube's interior—compressed between base 14 and follower 16. The spring remains in a compressed state in all the normal travel range of the follower within the magazine. The base is retained in a fixed position, so the degree of compression of the spring is determined by the vertical position of the follower within the tube. The spring urges the follower upward. The follower, in turn, urges the cartridges contained within the magazine upward.

The exemplary magazine assembly 10 has many other conventional features needed for the operation of a firearm. For example, magazine latch relief 20 receives a firearm magazine latch that holds the magazine in the firearm until a user releases the latch. Inward planar indentations 24 are provided in each of the side walls. These serve to guide the sides of the cartridges contained within the magazine and provide an additional volume rearward of the planar indentations for the rims of the cartridges. Angled indentations 26 (one on each side) assist the cartridges in traveling upward from the double-stack region of the magazine and through a transition region where the cartridges transition toward a single-stack configuration (though not necessarily a fully developed single-stack configuration).

Slide latch relief 22 is formed in the forward portion of follower 16. As those skilled in the art will know, a slide latch relief is needed so that—after the last round is fed from the magazine—a tab on the firearm's slide latch will move into relief 22 and cause the slide latch to hold the firearm's slide in the open position. Many other conventional features may be included in the inventive magazine. These include various types of feed lips, feed rails, and partial feed ramps. The inventive magazine may also include one or more openings that allow a user to see the number of cartridges contained in the magazine.

Figure 2:
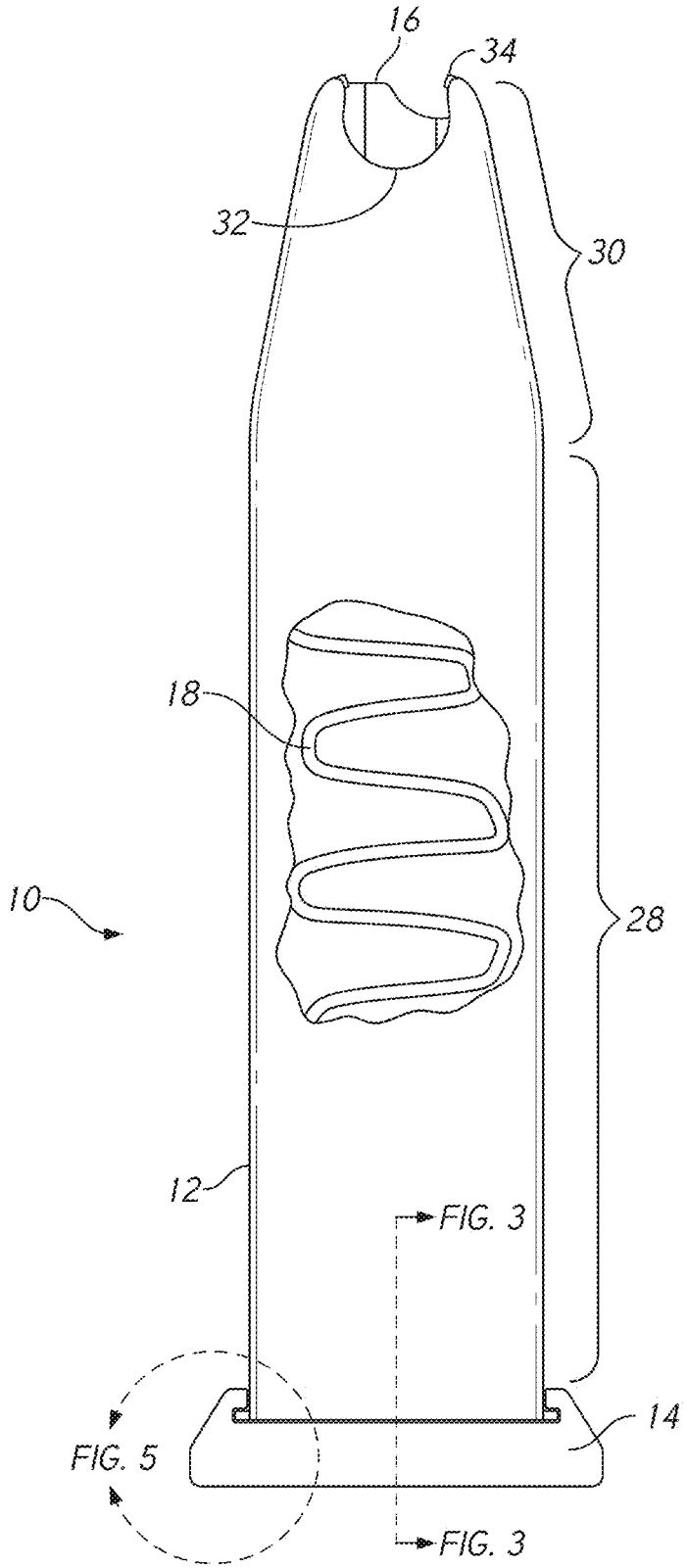
FIG. 2 is a rear elevation view with a cutaway, showing the embodiment of FIG. 1.

FIG. 2 shows the same exemplary embodiment in a rear elevation view. The reader will note how the two side walls angle inward when traveling from double stack region 28 of the magazine to transition region 30 and ultimately to the vicinity of feed rails/lips 34. The reader will note how the narrowing and partial closure of the top of the magazine tube "captures" follower 16 at the uppermost point in its travel. A cutaway in the rearward wall allows the reader to again see a portion of spring 18 as it rests within the magazine tube.

A magazine assembly is generally created by inserting the follower and spring through the open lower end of the tube. The spring is then compressed, and the lower end of the tube is closed by the addition of a base. In this context the term "base" should be broadly understood to mean a component or assembly of components that restrains the lower end of the magazine spring and closes the bottom of the magazine tube. There are endless ways to attach a base to the magazine tube. FIGS. 2-5 illustrate one good approach.

Figure 5:
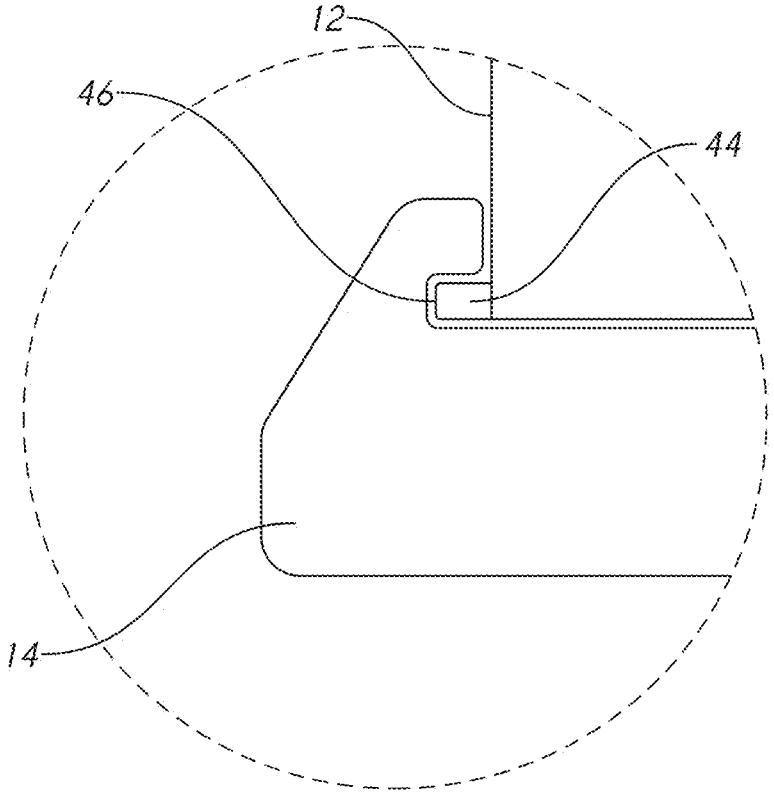
FIG. 5 is a detailed rear elevation view, showing how the base attaches to the tube in the embodiment of FIG. 1.

In FIG. 2, the reader will note a "callout" for FIG. 5. FIG. 5 provides a detailed view of a portion of FIG. 2. In FIG. 5, the reader will note how lateral flange 44 projects outward (to the left) at the bottom of tube 12. A second lateral flange projects from the right side of the tube to create a mirror image of the configuration shown in FIG. 5. Base 14 includes two lateral slots 46 designed to slidably engage the two lateral flanges 44. The base attaches to the tube by sliding the two lateral slots 46 over the two lateral flanges 44.

Figure 3:
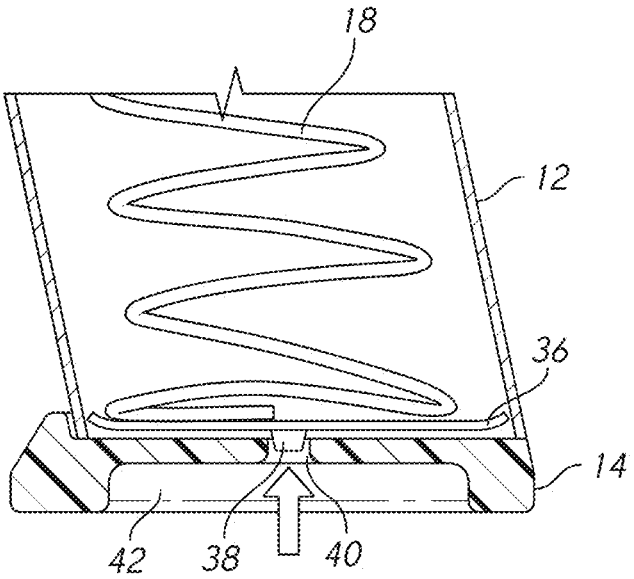
FIG. 3 is a sectional side elevation view, showing one embodiment of the magazine base.
Figure 4:
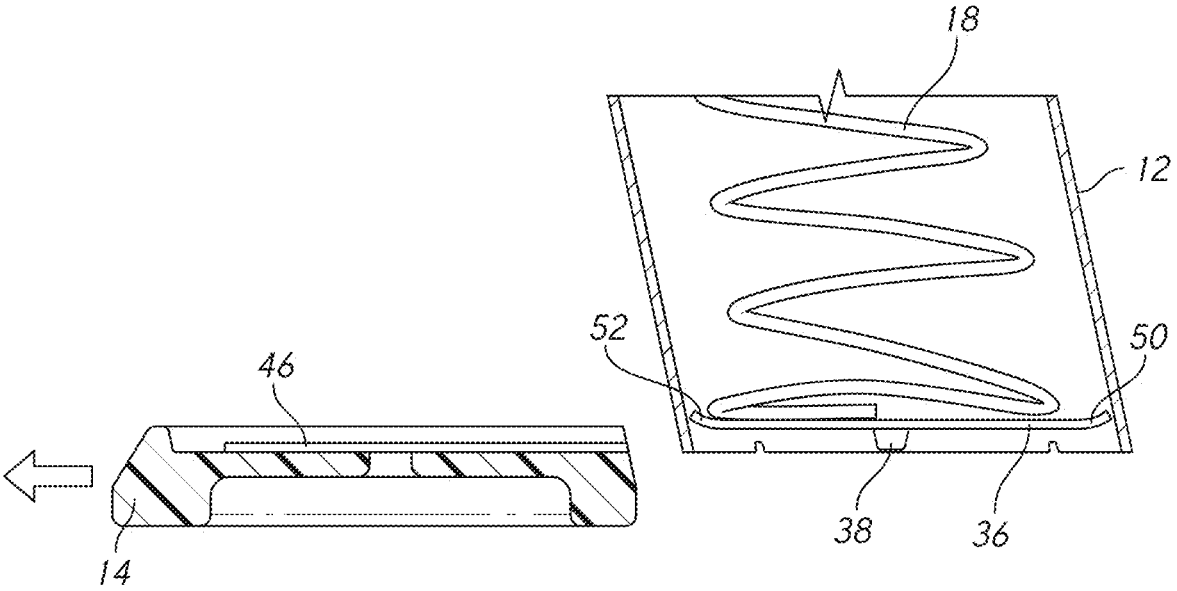
FIG. 4 is sectional side elevation view, showing the removal of the magazine base for the embodiment of FIG. 1.

FIGS. 3 and 4 illustrate the selective removal of the base from the tube. FIG. 3 shows a sectional view through the middle of the assembly (note callout in FIG. 2). Base 14 is secured to tube 12 via engagement of the lateral flanges on the tube with the lateral slots in the base. This arrangement allows the base to slide free of the tube when moved in the forward direction. However, the base is normally restrained by a second engagement. Plate 36 in this example is a thin metal plate that fits within the open bottom of the tube. Protrusion 38 extends downward from plate 36. Base 14 includes an opening 40 positioned to receive protrusion 38 as shown. Cavity 42 is preferably provided in the lower portion of base 14 to provide access to opening 40.

In order to remove the base from the tube, the user employs a pointed object to press upward on protrusion 38. This motion compresses spring 18 and raises protrusion 38 clear of opening 40. The user can then slide base 14 forward (to the left in the view of FIG. 3) to remove the base from the tube. FIG. 4 shows base 14 after it has been moved free of tube 12. The reader will note that lateral slots 46 in the base are clear of the lateral flanges on the tube. At this point plate 36 is free to slide out the bottom of the tube, along with the magazine spring and follower.

Still looking at FIG. 4, the reader will note how plate 36 in this embodiment has an upward tilting rearward portion 50 and an upward tilting forward portion 52. These tend to center the first coil of the magazine spring on plate 36. Many other variations are possible for the base. In some of these embodiments a depression can be integrally molded into the upward-facing surface of the base and this helps to locate the lower portion of the magazine spring. The invention is not limited to any particular type of base or combination of base and plate.

Figure 6:
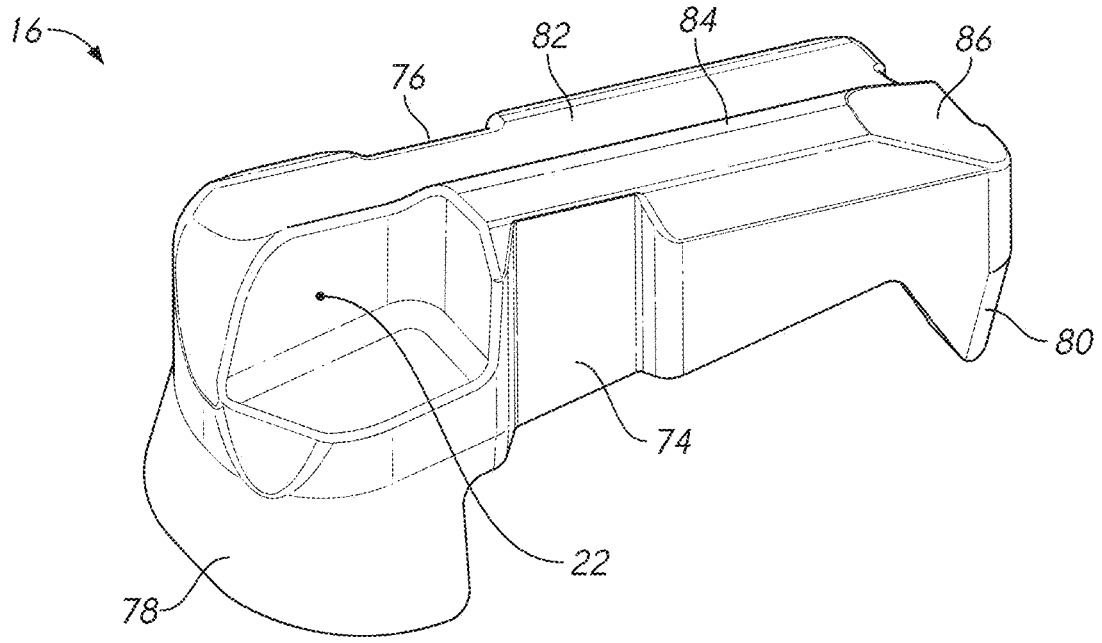
FIG. 6 is a perspective view, showing a follower configured for use in the present invention.

FIG. 6 provides a perspective view of an exemplary follower 16. Forward skirt 78 descends from the forward portion of the follower and rearward skirt 80 descends from the rearward portion. The upward-facing surface includes curved cradle 82. Ridge 84 blends curved cradle 82 into the upper portion of the follower. The curved cradle is shaped to engage the cylindrical exterior surface of the lowermost cartridge in a stack of cartridges. The shape of the cradle urges that cartridge to the right and upwards in this example.

Chamfer 86 is provided on the upper rear portion of the follower. The chamfer is provided to ease the passing of a cartridge base over the top of the follower as the last round is fed into the firearm. The chamfer also allows the advancing breech face (on the slide) to pass over the top of the follower in the event the user releases the slide latch and returns the slide to its forward position after the last round is fired.

Left notch 74 and right notch 76 are provided on the lateral sides of the follower. Left notch 74 engages angled indentation 26 on the left side of the magazine. This interaction helps to center the follower as it travels upward toward the top of the tube. Right notch 76 engages the angled indentation on the right side of the magazine.

Figure 7:
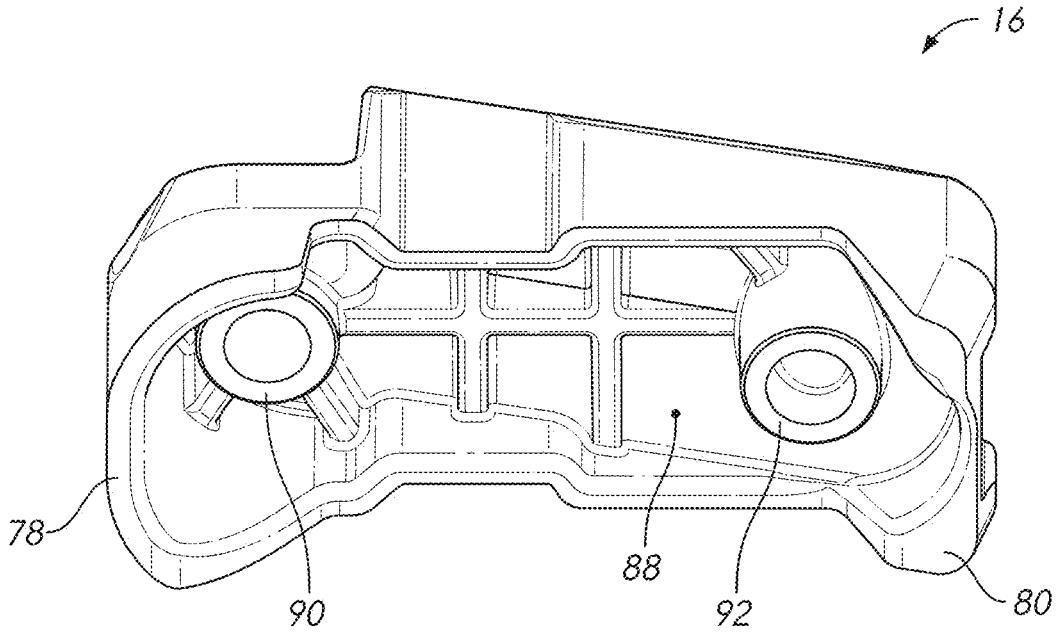
FIG. 7 is a perspective view, showing the underside of the follower of FIG. 6.

FIG. 7 shows the downward-facing portion of the follower. The lower portion opens into a hollow spring receiver cavity 88. The cavity is located between forward skirt 78 and rearward skirt 80 (and extends upward into the interior of the follower). Spring engagement features are preferably included. In this example, forward boss 90 and rearward boss 92 extend downward within the spring receiver cavity in order to engage the top of the spring.

Figure 8:
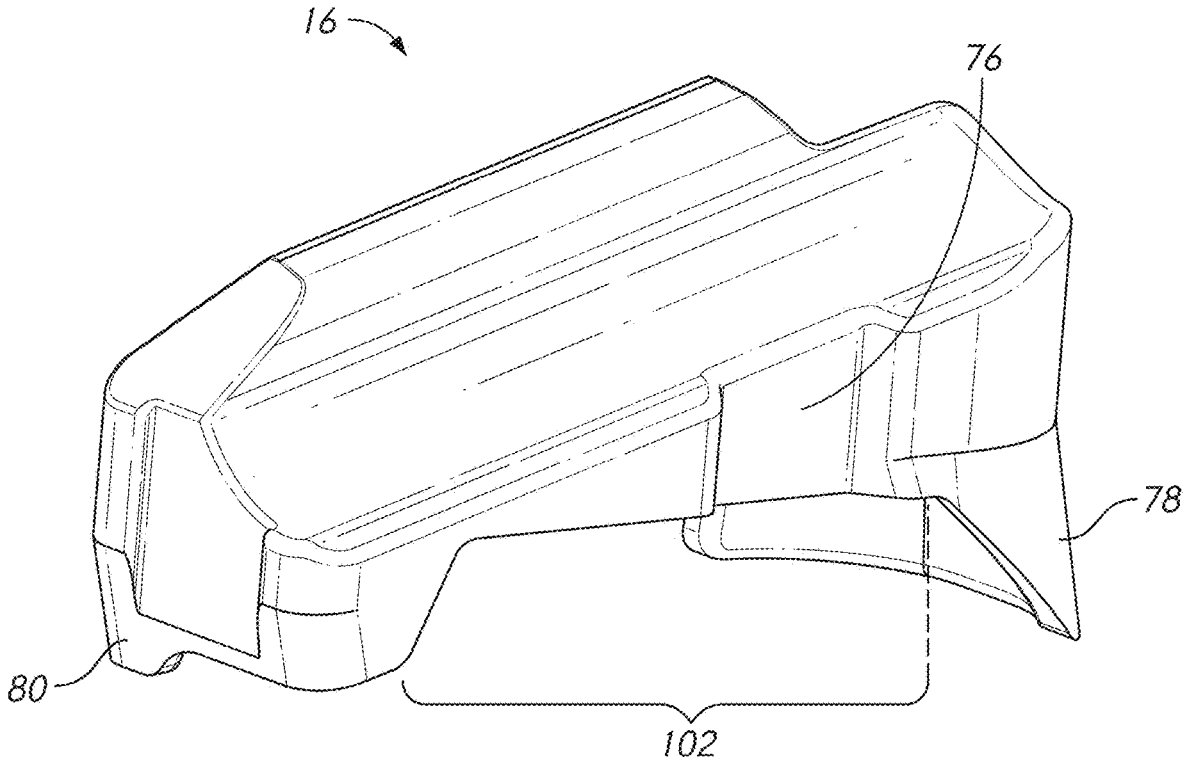
FIG. 8 is a perspective view, showing the right side of the follower of FIG. 6.

FIG. 8 provides a right side view of the same follower 16. Central lateral relief 102 is provided to accommodate the interaction of the follower and a compressed magazine spring—as will be explained in more detail subsequently.

Figure 9:
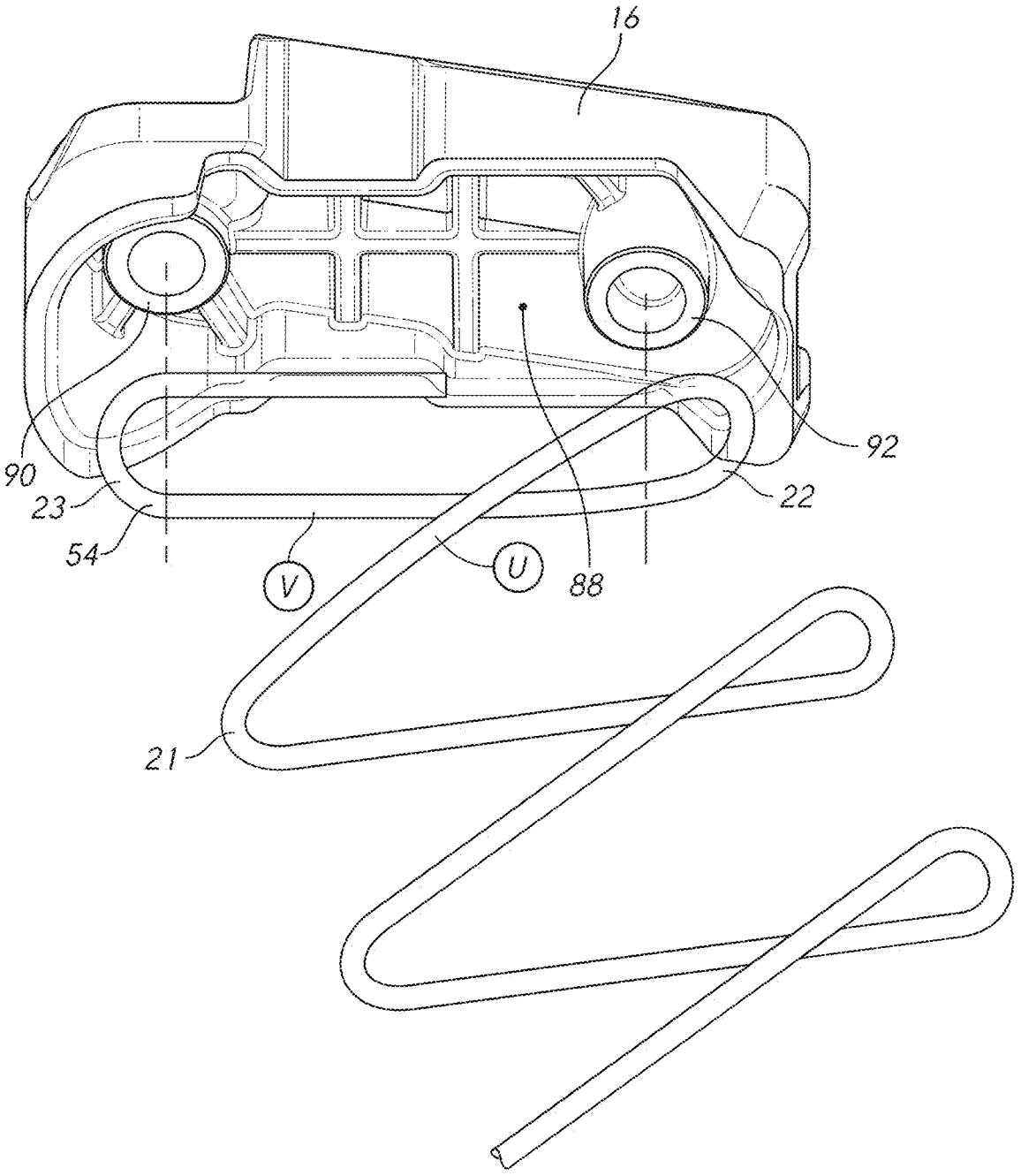
FIG. 9 is a perspective view, showing an exemplary attachment interface between the follower and the magazine spring.

FIG. 9 provides an exploded perspective view of follower 16 and the top of the magazine spring. The uppermost coil of the magazine spring fits around forward boss 90 and rearward boss 92. This engagement positively connects the follower to the spring. The reader will also note how additional coils of the upper portion of the magazine spring can nest around the bosses 90,92 and lie within spring receiver cavity 88 in the lower portion of follower 16.

The magazine spring used in the inventive magazine assembly includes some nesting coils that cooperate to reduce its overall height. Nesting coils are known in the prior art and have previously been used for this purpose. However, the inventive spring has a unique configuration in which coil segments on a first lateral side nest and corresponding coil segments on the opposite lateral side do not nest (They overlap). This produces an uneven stack height from left to right. In the example to follow, the right side is given a greater stack height than the left side. However, those skilled in the art will realize that a mirror of the example provided could also be created.

Figure 10:
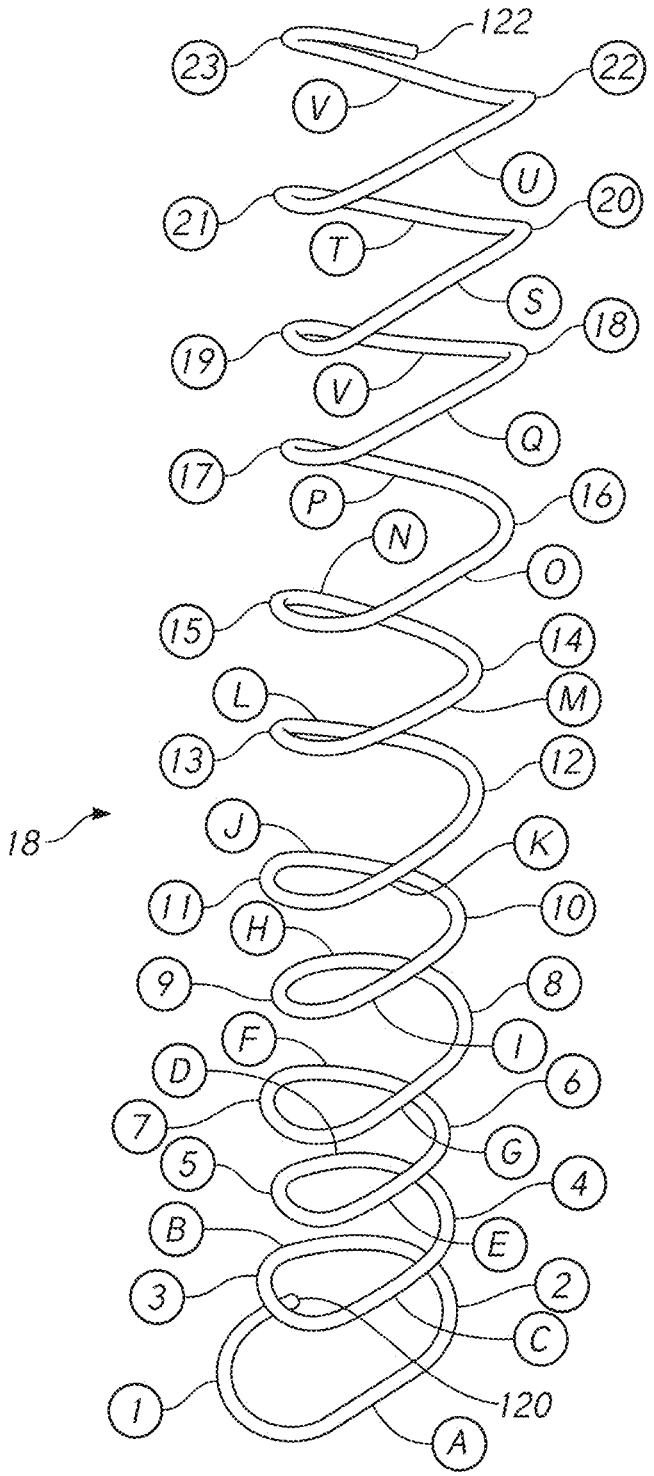
FIG. 10 is a perspective view, showing a magazine spring made according to the present invention in an uncompressed state.

FIG. 10 shows a perspective view of an exemplary inventive magazine spring in an uncompressed state. Most compression springs follow a helical path, but spring 18 has a much more complex shape. The lower portion is curved but sized to fit within the rectangular horizontal cross section of the double stack portion of the magazine tube. The upper portion transitions into a different ratio of length to width in order to fit within transition region 30 near the top of the magazine tube.

Some exemplary dimensions will serve to illustrate the changing nature of the coils as one proceeds from the lower end to the upper end of the spring. Proximate lower end 120, the spring is 1.180 inches (3.00 cm) long and 0.86 inches (2.18 cm) wide. Proximate the middle (of the overall height) the exemplary spring is 0.86 inches long (2.18 cm) and 0.59 (1.50 cm) inches wide. Near the very top the exemplary spring is 0.97 inches (2.46 cm) long and 0.31 inches (0.79 cm) wide.

As the spring is a continuous swept section—with the section ideally being uniform—it is difficult to describe using conventional terminology. Accordingly, a new descriptive lexicon is employed. It is known in the art to describe a spring in terms of each "coil"—with a coil representing each 360-degree revolution of the swept section. In the present nomenclature, each coil is further divided into four regions—forward, left, rearward, and right regions. The forward region lies proximate the forward wall of the magazine tube. The left region lies proximate the left wall. The rearward region lies proximate the rearward wall. The right region lies proximate the right wall. This type of description is useful in describing the behavior of the spring as it is compressed.

The lowermost forward region is denoted as "1" in FIG. 10. The lowermost rearward region is denoted as "2." The lowermost left region is denoted as "A." Proceeding around the first coil of the spring, the nomenclature is therefore lower end 120, followed by forward region 1, followed by left region A, followed by rearward region 2, followed by right region B. In this system, the forward regions are given odd numbers, and the rearward regions are given even numbers.

Figure 11:
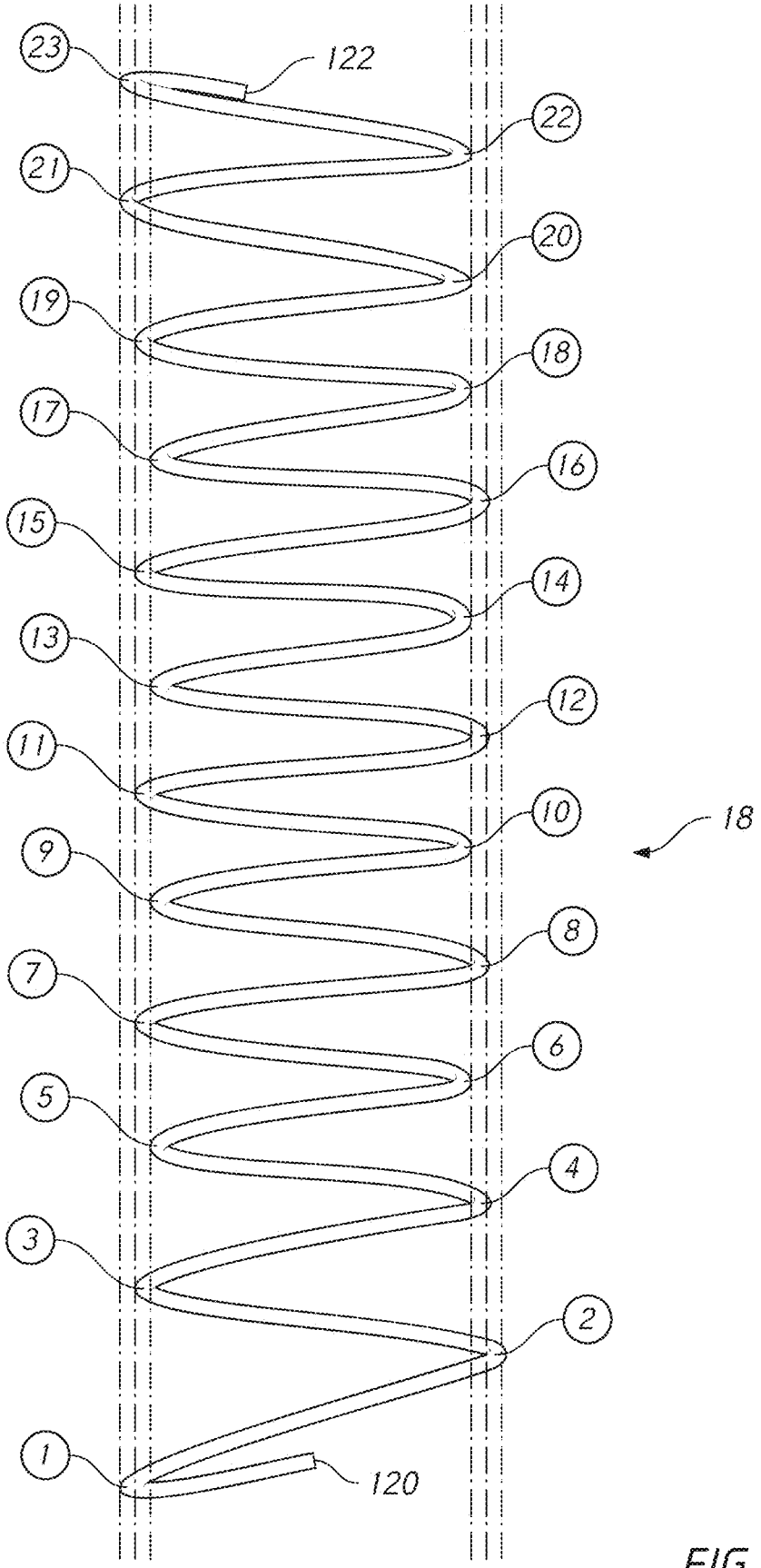
FIG. 11 is a side elevation view, showing the magazine spring of FIG. 9.

FIG. 11 shows a left side elevation view of the same spring 18. In this orientation the forward regions of the spring coils are toward the left and the rearward regions are toward the right. The reader will note that the forward regions of the coils are given odd numbers—1, 3, 5, 7,9, and so on. The rearward regions are given even numbers—2, 4, 6, 8, and so on. FIG. 10 is a perspective view of the same spring shown in a left side elevation view in FIG. 11—and the nomenclature coincides between the two views.

Figure 12:
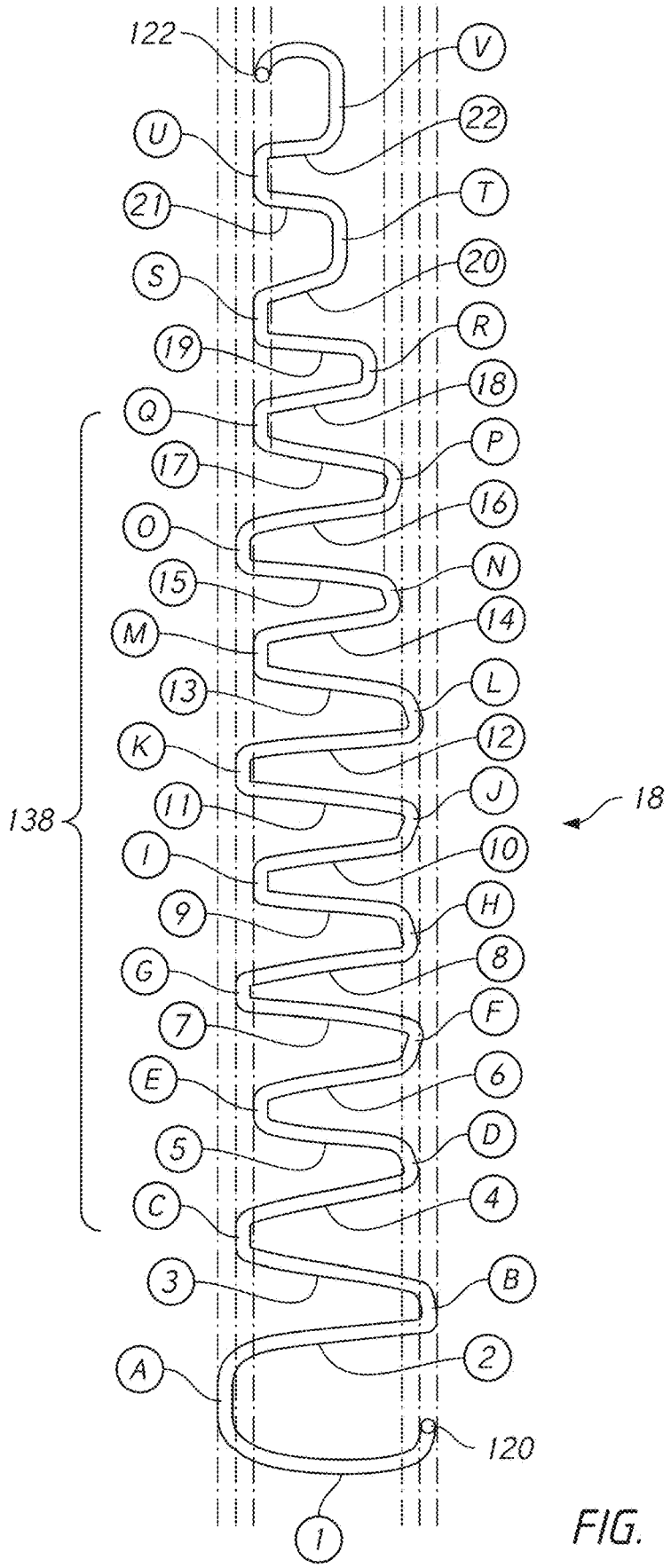
FIG. 12 is a rear elevation view, showing the magazine spring of FIG. 9.

FIG. 12 provides a rear elevation view of the same spring 18. The left regions are given the letters A, C, E, G, I, and so on. The right regions are given the letters B, D, F, H, and so on. The numbers for the forward and rearward regions are also shown in FIG. 12, so that the reader can more easily compare the rear elevation view of FIG. 12 with the perspective view of FIG. 10.

The spring and the follower of the magazine assembly are designed to produce specific and predictable behavior when the spring is compressed. To understand the motivations underlying this desired behavior the reader should consider the state of the magazine with varying number of cartridges contained therein.

Figure 13:
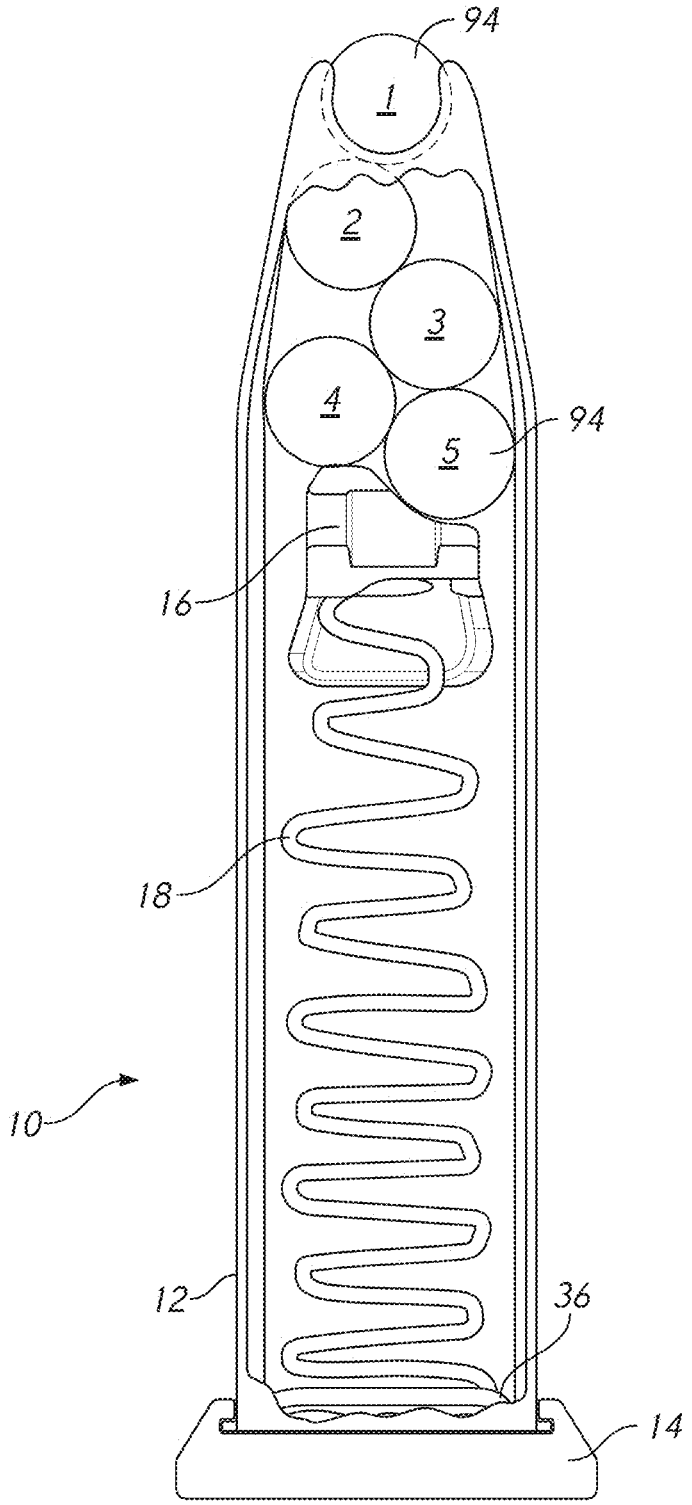
FIG. 13 is a rear elevation view with a cutaway, showing the magazine spring in a partially compressed state.

FIG. 13 shows magazine assembly 10 with only five cartridges 94 loaded. Spring 18 is in a relatively uncompressed state (The term "relatively" is used since the spring is compressed as it is loaded into the magazine tube and captured by the base. Thus, the spring is compressed in all operational states of the magazine.). Follower 16 is positioned near the top of the double stack region.

Figure 17:
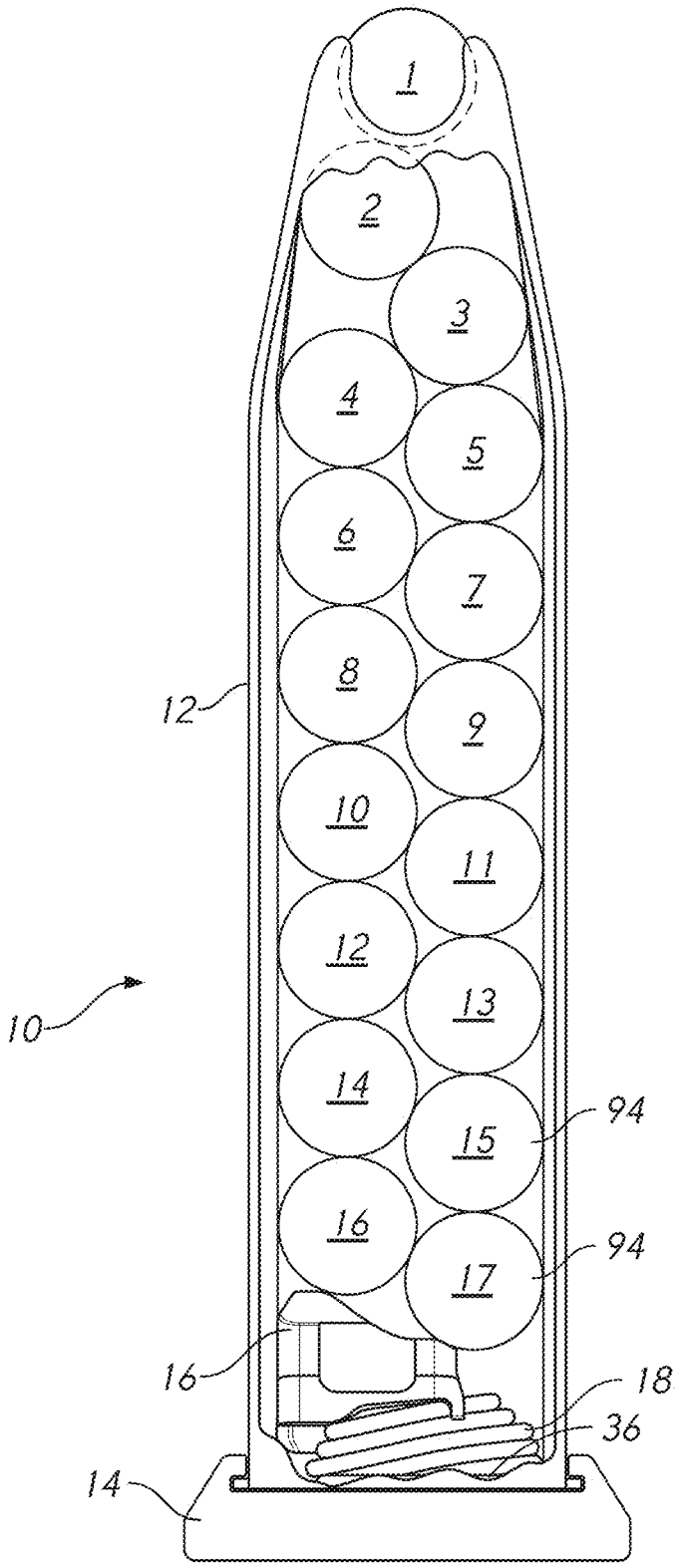
FIG. 17 is a rear elevation view with a cutaway, showing a magazine in a fully loaded state.

FIG. 17 shows the same magazine assembly with seventeen cartridges 94 loaded. This represents the maximum loaded capacity of the particular magazine shown. Follower 16 has shifted to the left and overlaps somewhat with the stacked coils of spring 18 that protrude out the right side of the follower as spring 18 nears its maximum compression. The lateral motion and overlapping of the follower and spring is actually the result of the compression behavior of the spring—as will be more particularly described hereafter.

The reader should note that the position of the components in FIG. 17 represents the maximum loaded state for this particular design—with the magazine ready to deliver the uppermost cartridge and continue to feed additional cartridges into the uppermost position. However, this is not the position of absolute maximum compression for the spring. As those skilled in the art will know, the follower needs to move slightly further downward from the position shown in FIG. 17 in order for a user to feed in the uppermost of the seventeen cartridges while loading the magazine. The stack must be forced slightly downward when loading the final cartridge and then—when the uppermost of the seventeen cartridges is loaded—the user releases the downward pressure, and the stack moves slightly back upward to the position shown in FIG. 17. Thus, a well-designed spring still retains a slight amount of additional available compressive travel even when the magazine is fully loaded.

With these operational objectives in mind, some of the detailed characteristics of a spring made according to the present invention will be explained. Returning to FIG. 11, the reader will note the presence of eight vertically oriented phantom lines in the view. These are provided to allow the relationship between the regions of neighboring coils to be more easily seen. Still looking at FIG. 11, the reader will appreciate that when the spring is compressed to nearly its maximum possible extent, the following nesting or overlapping characteristics occur with respect to the forward and rearward regions of the coils:

(1) Forward region 3 nests inside forward region 1;
(2) Rearward region 4 nests inside forward region 2;
(3) Forward region 5 nests inside forward region 3;
(4) Rearward region 6 nests inside rearward region 4;
(5) Forward region 7 nests outside of forward region 5 but on top of forward region 3;
(6) Rearward region 8 nests outside of rearward region 6 but on top of rearward region 4;
(7) Forward region 9 nests inside of forward region 7 but on top of forward region 5;
(8) Rearward region 10 nests inside rearward region 8 but on top of rearward region 6;
(9) Forward region 11 nests outside of forward region 9 but on top of forward region 7;
(10) Rearward region 12 nests outside of rearward region 10 but on top of rearward region 8;
(11) Forward region 13 nests inside of forward region 11 but on top of forward region 9;
(12) Rearward region 14 nests inside of rearward region 12 but on top of rearward region 10;
(13) Forward region 15 nests outside of forward region 13 but on top of forward region 11;
(14) Rearward region 16 nests outside of rearward region 14 but on top of rearward region 12;
(15) Forward region 17 nests inside of forward region 15 but on top of forward region 13;
(16) Rearward region 18 nests inside of rearward region 16 but on top of rearward region 14;
(17) Forward region 19 nests outside of forward region 17 but on top of forward region 15;
(18) Rearward region 20 rests directly on top pf rearward region 18;
(19) Forward region 21 rests outside of forward region 19 and outside of all other forward regions save forward region 1;
(20) Rearward region 22 rests on top of rearward region 20; and
(21) Forward region 23 rests on top of forward region 21.

Figure 18:
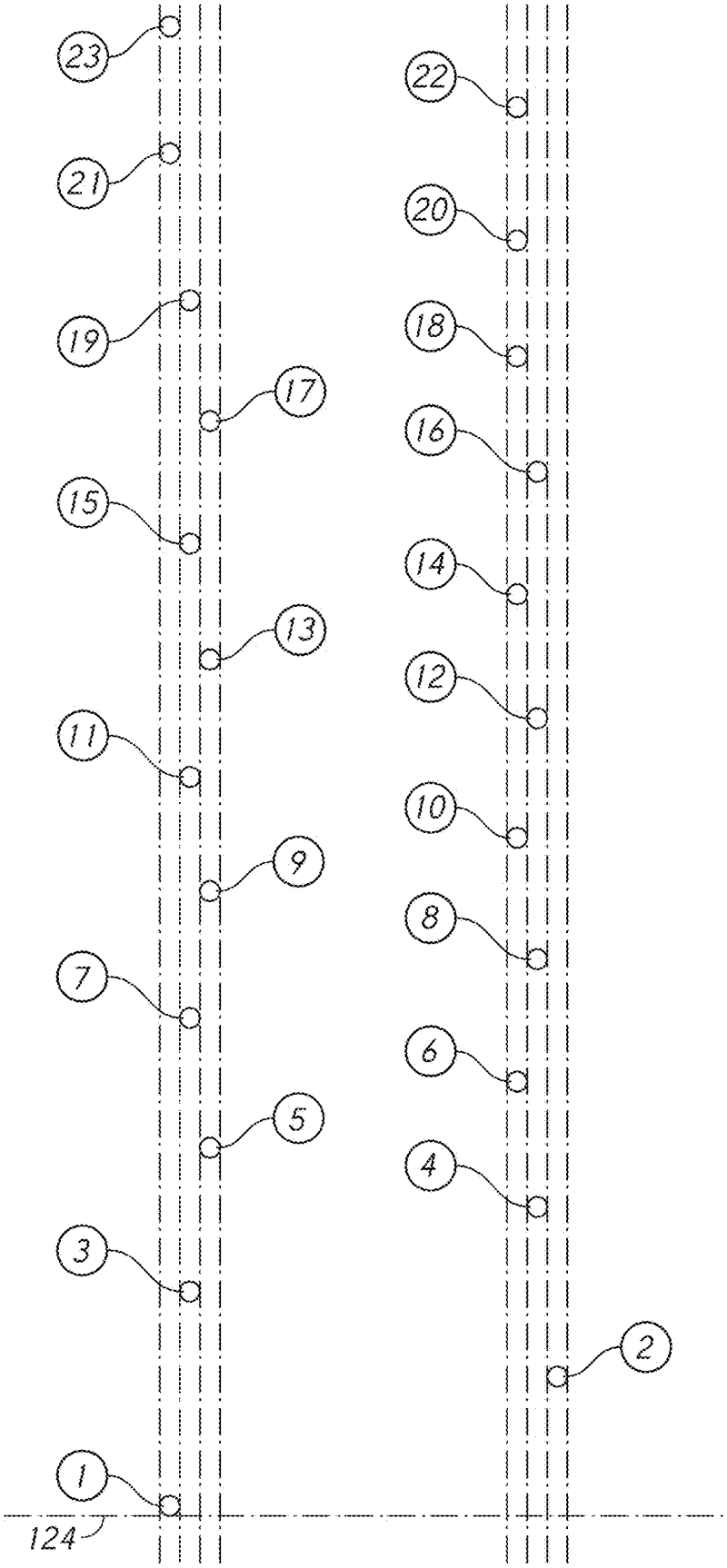
FIG. 18 is a side elevation sectional view, showing the positions of multiple cross sections of the magazine spring in an uncompressed state.
Figure 19:
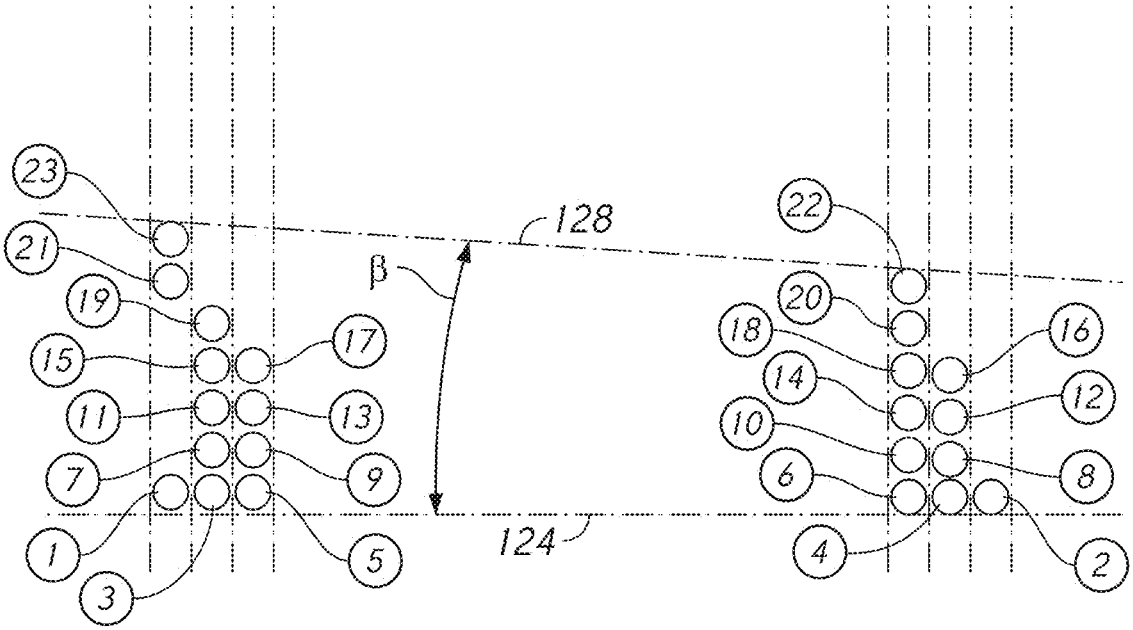
FIG. 19 is a side elevation sectional view, showing the positions of multiple cross sections of the magazine spring in a state nearing maximum compression.

These relationships are graphically depicted in FIGS. 18 and 19. FIG. 18 shows the cross sections of the spring in an uncompressed state—for the forward regions 1, 3, 5, 7, 9, 11, 13, 15, 17, 19, 21, 23 and the rearward regions 2, 4, 6, 8, 10, 12, 14, 16, 18, 20, 22. FIG. 19 shows the same cross sections as the spring is nearing its fully compressed state. Note that the scale of FIG. 19 is increased with respect to FIG. 18 in order to aid visualization.

The regions stack and nest as described (The terms "nest" or "nesting with" means one region nesting either inside or outside of another region). The result is that the rearward regions form a stack that is a bit more than six cross sections high, while the forward sections form a stack that is a bit more than seven cross sections high. The term "a bit more" is used to indicate the fact that the spring is not fully compressed—full compression occurring when adjacent coils touch each other and foreclose further spring action. Rather, the state of compression shown is when the sections are close to touching but not quite touching.

Upper plane 128 passes over the top of forward region 23 and rearward region 22. The reader will note that upper plane 128 is inclined upward (The forward end is higher) through an angle β compared to lower plane 124 (an upper portion of the magazine spring inclines so that an uppermost forward region of an uppermost coil is above an uppermost rearward region of the same uppermost coil). This small amount of inclination is desirable, because it compensates for the fact that most cartridges do not stack in a pure vertical column. Instead, they stack in an arcuate column.

Figure 20:
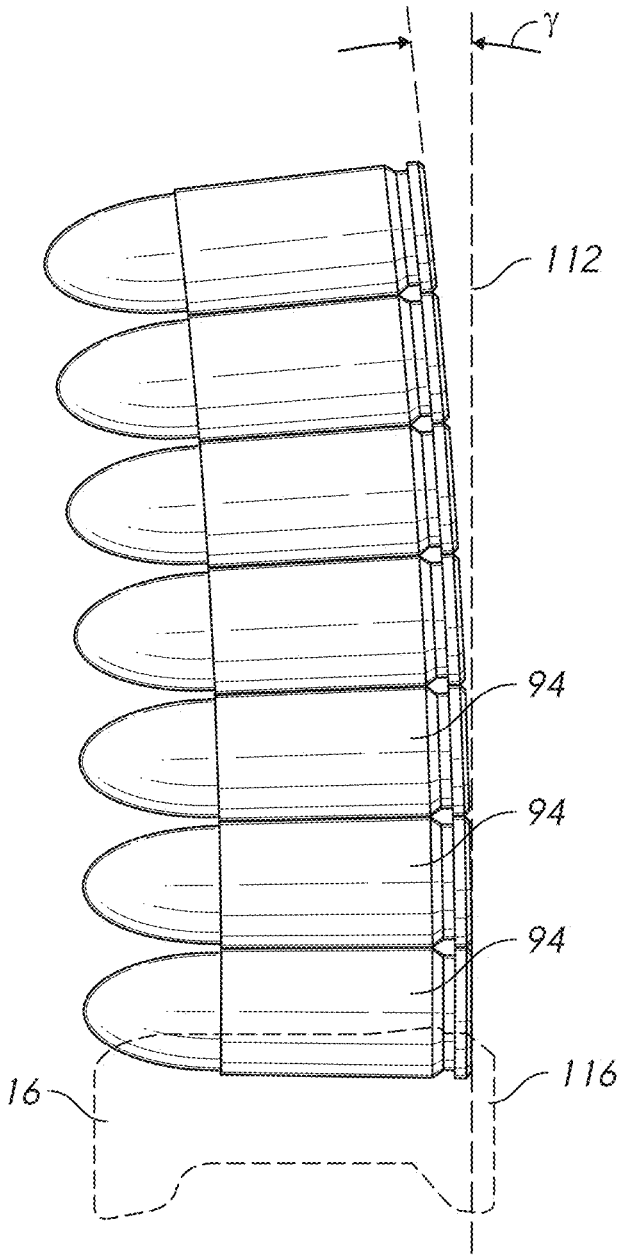
FIG. 20 is a side elevation view, showing the arcuate nature of a stack of cartridges.

FIG. 20 illustrates this phenomenon for a 9 mm parabellum cartridge. The cartridge case of the 9 mm parabellum cartridge tapers from the rearward to forward direction. This taper means that when the cartridges are stacked as shown, they create an arc rather than a straight line. This arc increases as the stack grows, resulting in a deviation angle γ from vertical plane 112. It is thus desirable for follower 16 to tilt as it is forced further and further down into the magazine by loading more cartridges.

Returning to FIG. 19, the reader will note that the upward tilt of the forward end of the magazine spring tends to tilt the forward portion of the attached follower upward. This is generally desirable, since it means the lowermost cartridge—the one directly above the follower—will be tilted so that its forward end is raised. The arcuate nature of the column then means that the uppermost cartridge—the one about to be stripped off the top of the magazine—has a horizontal orientation.

FIGS. 11, 18, and 19 thus serve to illustrate the compressive behavior of the magazine spring when viewed from the left side. The spring's behavior when viewed from the rear is very different, and it is intended to be very different. FIG. 12 shows the same spring from the rear-looking forward. Vertical reference lines are again provided to aid visualization. The reader will appreciate that when the spring is compressed to nearly its maximum possible extent (approaching maximum compression), the following nesting or overlapping characteristics occur with respect to the left and right regions of the coils:

(1) Left region C nests inside left region A;
(2) Right region D nests inside right region B;
(3) Left region E nests inside left region C;
(4) Right region F stacks on top of right region D (owing to the fact that region F travels laterally outward toward the right magazine tube wall while region D travels laterally inward away from the right tube wall—the midpoint of these two regions are aligned vertically);
(5) Left region G nests outside left region E but on top of left region C;
(6) Right region H stacks on top of right region F (owing to the fact that region H travels laterally inward while region D travels laterally outward);
(7) Left region I nests inside of left region G but on top of left region C;
(8) Right region J stacks on top of right region H (owing again to non-aligned direction of travel);
(9) Left region K nests outside of left region I but on top of left region G.
(10) Right region L stacks on top of right region J (owing again to non-aligned direction of travel);
(11) Left region M nests inside of left region K but on top of left region I;
(12) Right region N nests inside of right region L;
(13) Left region O nests outside of left region M but on top of left region K;

(14) Right region P stacks on top of right region N (owing again to non-aligned direction of travel);

(15) Left region Q stacks inside left region O but on top of left region M;

(16) Right region R stacks inside of right region P;

(17) Left region S stacks on top of left region Q;

(18) Right region T stacks inside of right region R, but the overlap in other portions of the relevant coil prevents nesting; and

(19) Left region U stacks on top of left region S.

Figure 14:
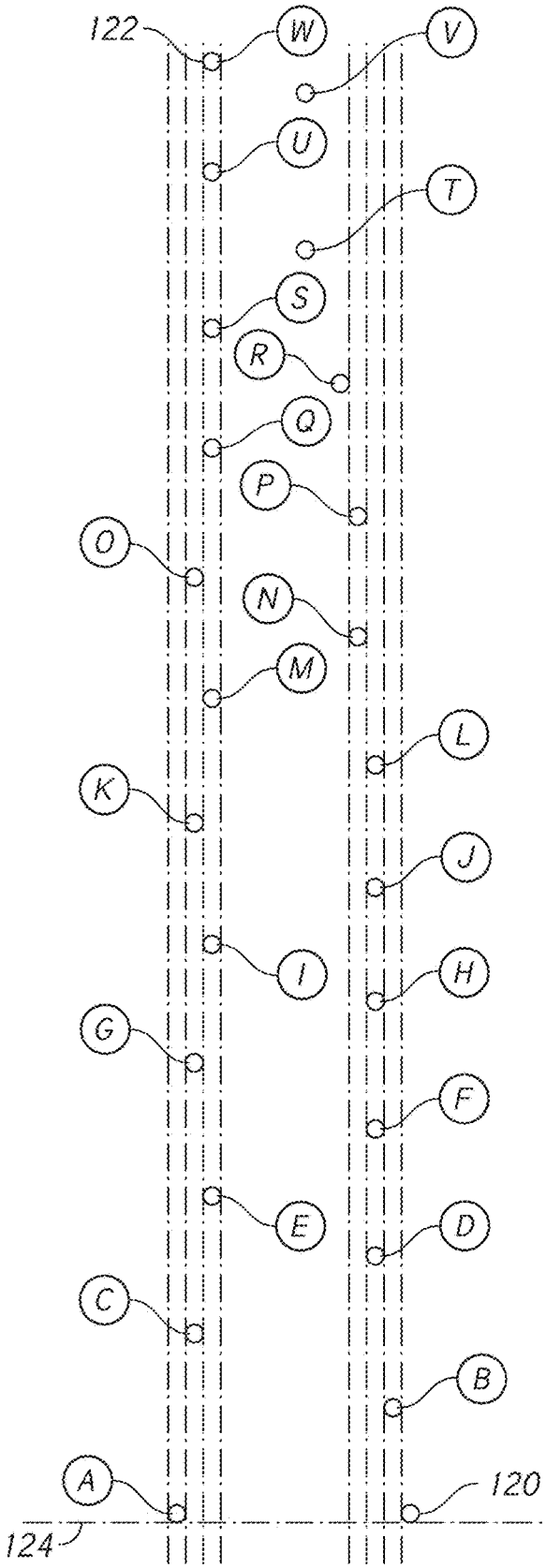
FIG. 14 is a rear elevation sectional view, showing the positions of multiple cross sections of the magazine spring in an uncompressed state.
Figure 15:
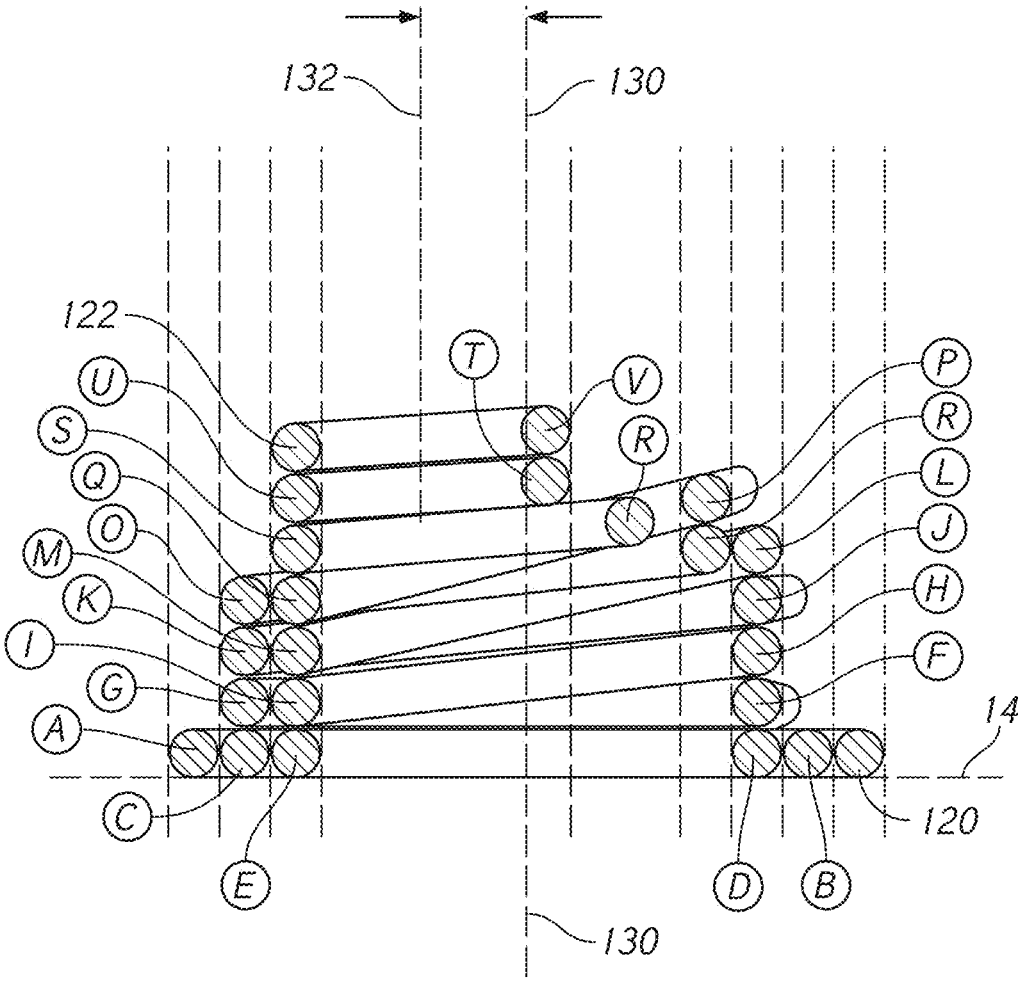
FIG. 15 is a rear elevation sectional view, showing the positions of multiple cross sections of the magazine spring in a state nearing maximum compression.

Still looking at FIG. 12, the reader will thus appreciate that within asymmetric stack height region 138, the left regions (C-Q) stack to a lower overall height than the right regions (D-P). The creation of the uneven stack heights from left to right is graphically depicted in FIGS. 14 and 15. FIG. 14 shows the cross sections of the spring in an uncompressed state (viewed from the rear)—for the left regions A, C, E, G, I, K, M, O, Q, S, U, W and the right regions B, D, F, H, J, L, N, P, R, T, V. FIG. 15 shows the same cross sections as the spring is nearing its fully compressed state. The scale of FIG. 15 is increased to aid visualization.

The regions stack and nest as described in the previous numbered paragraphs. The result is that for regions A through P the left regions form a stack that is a bit more than four cross sections high (regions A through O) while the right regions form a stack that is a bit more than six sections high (regions B through P). This uneven nesting produces a significant stack height difference from left to right—also resulting in a tilting of the compressed spring in this region.

Figure 16:
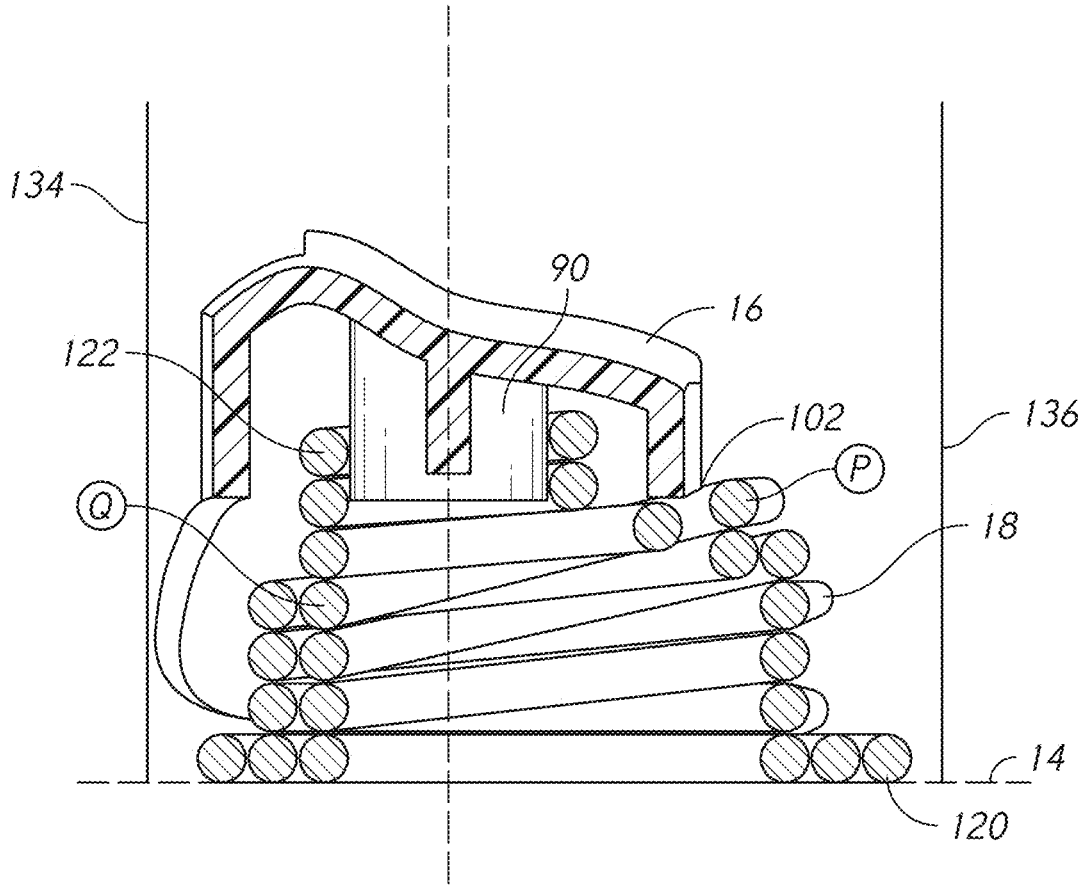
FIG. 16 is a rear elevation sectional view, showing the assembly of a magazine spring and a follower in a state nearing maximum compression.

The upper coils shown in FIG. 15 have a more horizontal orientation (not so severely tilted as the path from region P to region Q, for example). This lessened tilt is the result of the influence of the follower. The follower is not shown in FIG. 15, but the tilt of the upper coils is constrained by their engagement with the bosses on the underside of the follower. This engagement is shown in FIG. 16—where the user will see how the upper coils wrap around forward boss 90 and the boss limits the inclination of these coils. FIG. 15 shows the upper coils as they appear when constrained by the follower, even though the follower is not shown in FIG. 15.

Returning now to FIG. 15, the reader will also note a lateral displacement from the bottom of the stack to the top. Spring base centerline 130 passes through the middle of the lowest coil. Upper coil centerline 132 passes through the middle of the highest coil. The highest coil is laterally displaced from the lowest coil. For the exemplary dimensions provided earlier, this lateral displacement is about 0.15 inches (3.8 mm) between spring base centerline 130 and upper coil centerline 132.

In order to perceive the advantage of this novel spring structure, it is important to consider the spring and follower acting together. FIG. 16 shows a section view through follower 16 and the attached magazine spring 18. Looking briefly at FIG. 7, the section is taken between rearward boss 92 and forward boss 90—looking toward the forward boss. Returning to FIG. 16, the reader will note how the lateral side having the higher stack height protrudes laterally out through central lateral relief 102 of follower 16. The semi-helical path of the spring proceeds around from section P to section Q—which serves to illustrate the dramatic difference in stack height from left to right. In effect, the additional stack height provided for the right side is allowed to "spill" laterally out the right side of the follower (through central lateral relief 102). A portion of the spring shifts right and the follower shifts left against left magazine wall 134 and away from right magazine wall 136.

FIG. 17 shows the entire magazine assembly in this configuration. The compressive characteristics of the inventive spring and follower mean that the assembly employs vertical nesting (which is known), but also a degree of lateral nesting (which is not previously known). The lateral nesting is the result of the deliberate uneven stack height from right to left. The lateral nesting allows the follower to travel downward further than would be possible with vertical nesting alone—thereby creating additional internal volume for the magazine. In the example shown, the additional clearance provides room for seventeen cartridges to be accommodated in a space that could previously only house 16 cartridges. Conversely, if desired, the use of a tilting spring allows for the same magazine capacity as for the prior art with a reduction in the overall height of the magazine.

Figure 21:
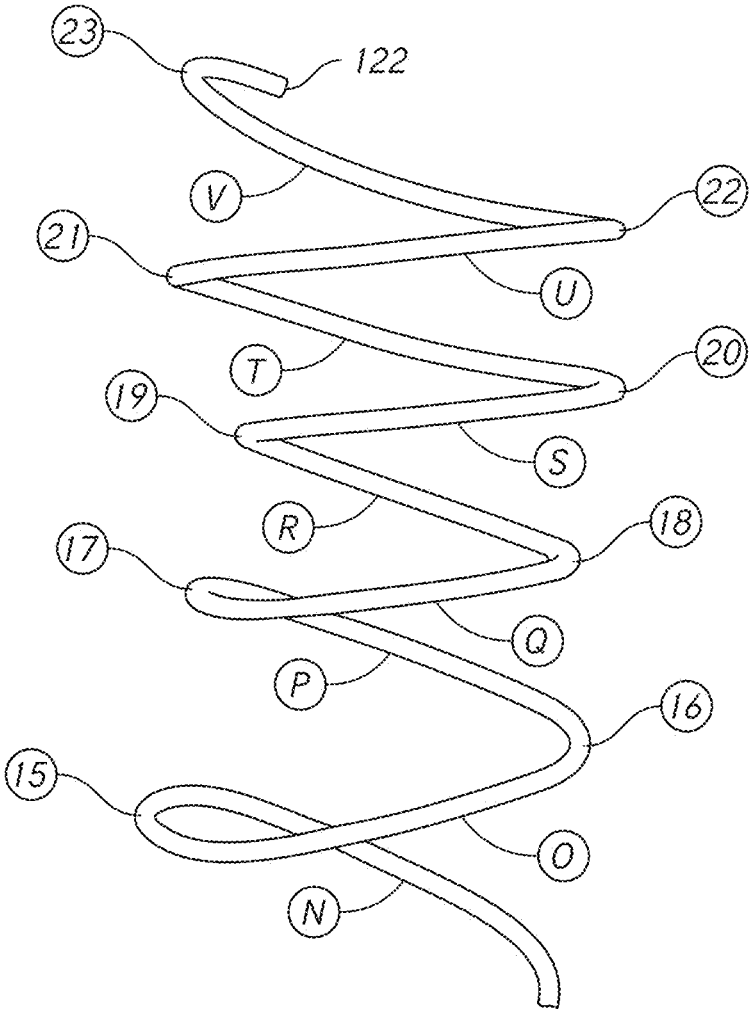
FIG. 21 is a perspective view, showing the upper portion of an additional embodiment of the inventive spring.

FIGS. 21-25 illustrate another embodiment of the inventive spring that provides additional nesting in the upper region. FIG. 21 shows the upper region of the spring in detail. The same nomenclature is used as for the embodiment shown in FIG. 10. The portions of the spring below forward region 17 are in fact identical to the embodiment of FIG. 10—only the upper portion is different. In the embodiment of FIG. 21, forward region 19 nests inside forward regions 17 and 21. Further, left region S nests inside of left region Q.

Figure 22:
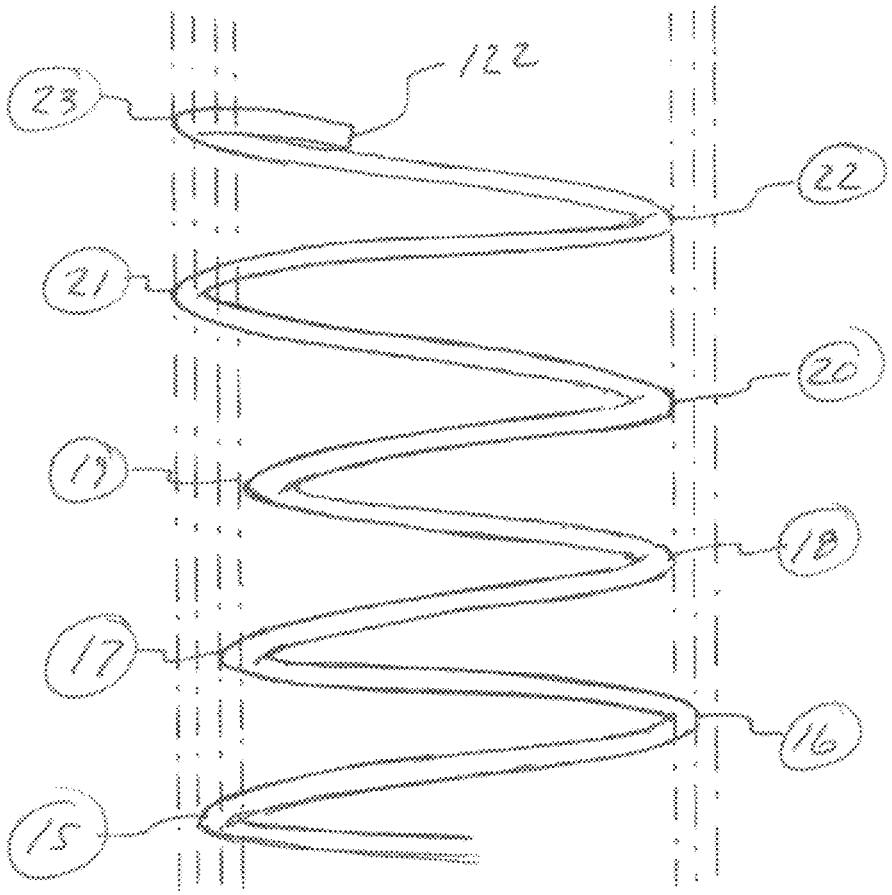
FIG. 22 is a side elevation view, showing the embodiment of FIG. 21.
Figure 23:
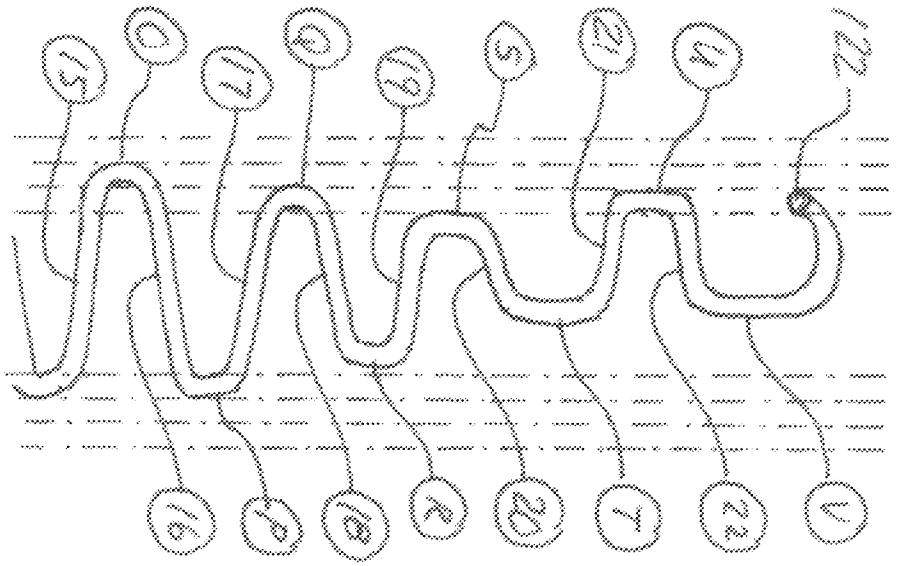
FIG. 23 is a rear elevation view, showing the embodiment of FIG. 21.

FIG. 22 shows a side elevation view of the same region. The reader will note how forward region 19 is not as far forward as forward regions 17 and 21. FIG. 23 shows a rear elevation view of the same portion of this embodiment. The reader will note how left region S is positioned to nest inside left regions Q and U. Right region R nests outside right region T and inside right region P.

Figure 24:
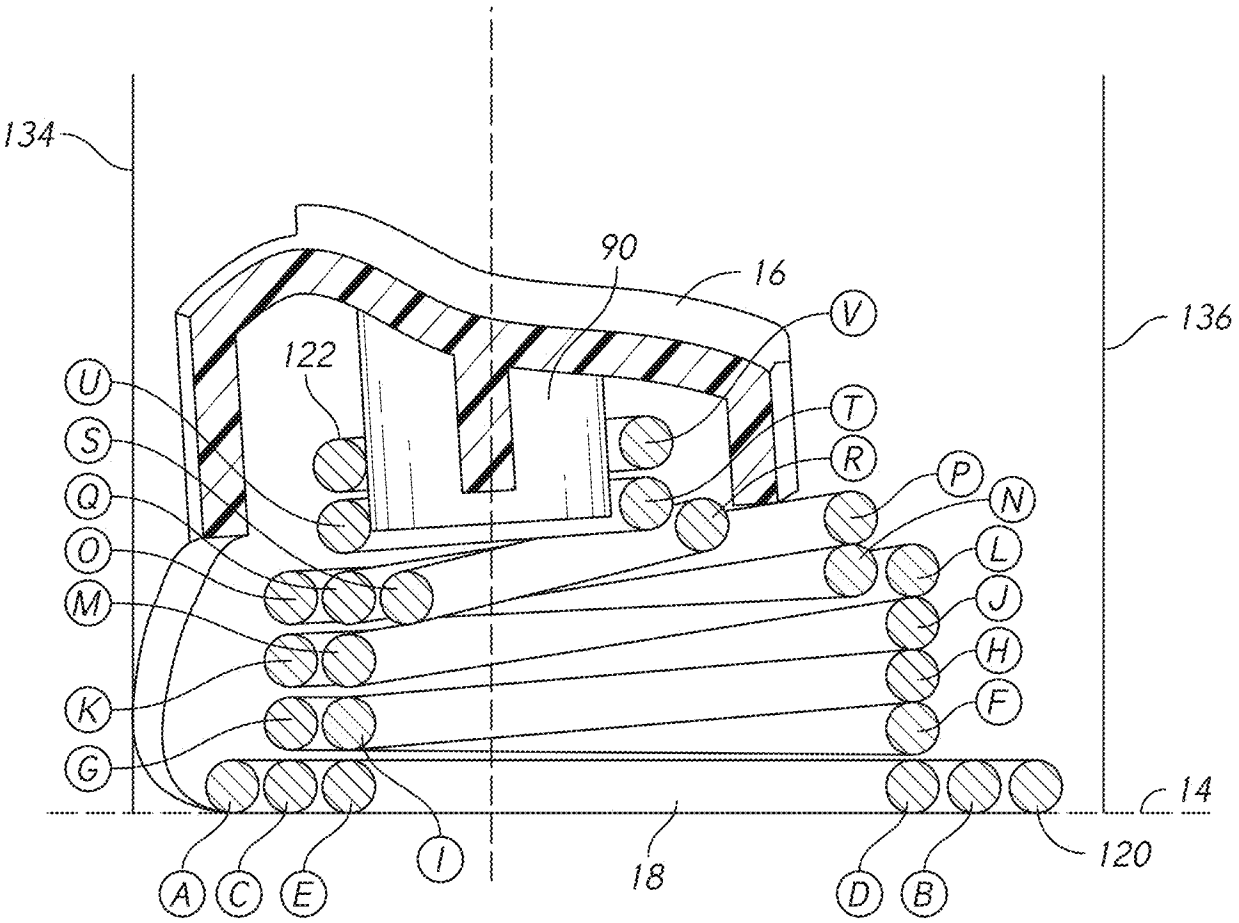
FIG. 24 is a sectional elevation view, showing the interaction of a follower with the spring of FIG. 21.

FIG. 24 shows the spring embodiment of FIG. 21 assembled with a follower 16. The assembly is nearing full compression—such as shown for the prior embodiment in FIG. 16. The reader will note how left region S nests inside left region Q. This allows left region U to move further downward (allowing the follower to move further downward with it). Thus, the follower is able to descend all the way to base the 14 of the magazine tube. In this example, follower 16 tilts slightly but this does not impair its function. These additional nesting features produce an even greater difference in the stack height between the left side and right side of the spring when it is nearing full compression.

Figure 25:
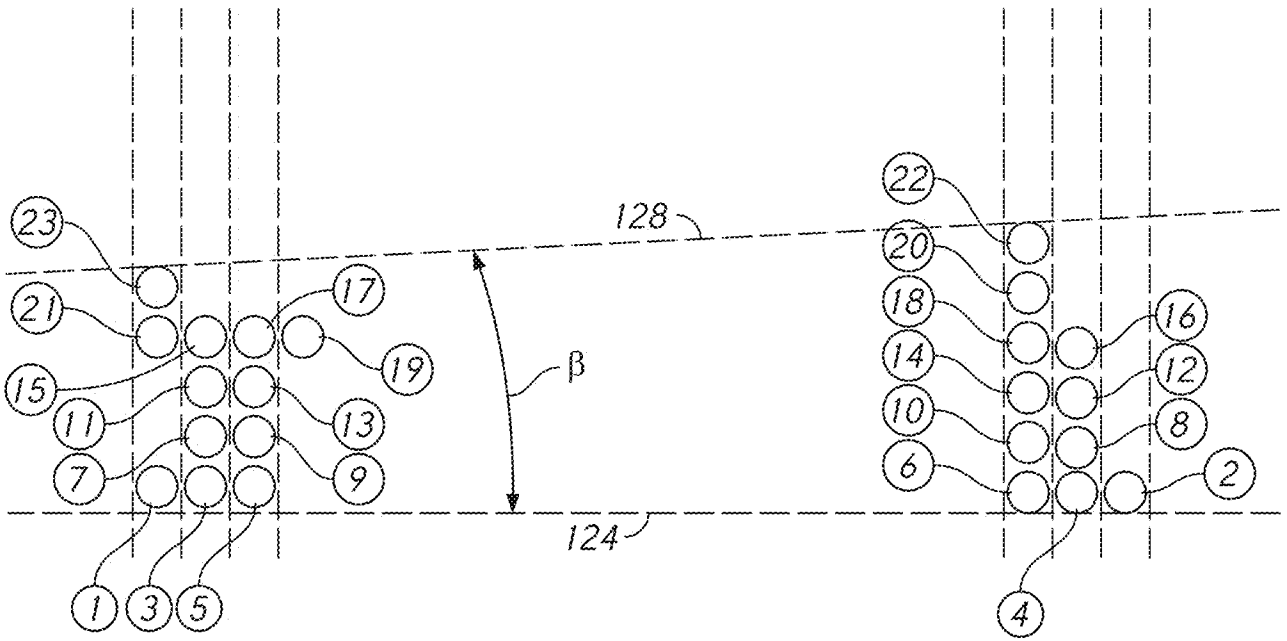
FIG. 25 is a side elevation view, showing the embodiment of FIG. 21.

FIG. 25 shows a side elevation view of the spring embodiment of FIG. 21 when it is nearing maximum compression. The reader will observe how forward region 19 nests inside forward region 17, allowing forward regions 21 and 23 to translate downward as shown. The result is that the inclination angle β for upper plane 128 becomes negative (the forward portion is lower than the rearward portion). Altering the nesting characteristics of the forward and rearward regions alters the inclination of the upper plane—allowing the follower inclination to be adjusted for differing cartridge cases.

Having reviewed this disclosure, numerous other embodiments will occur to those skilled in the art. As an example, it is possible to provide an alternate embodiment for the magazine spring and follower that is a mirror image (from left to right) of the ones depicted. In this alternate embodiment, the spring will tilt toward the right wall of the magazine tube when nearing maximum compression. It is also possible to apply the invention to alter the forward and rearward stack height so that the inclination of the upper plane 128 is altered as desired.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

I claim:

1. A magazine for feeding a plurality of cartridges into a firearm, comprising:

(a) a tube having a lower end, an upper end, a forward wall, a left wall, a rearward wall, and a right wall;

(b) a base closing said lower end of said tube;

(c) a follower within said tube, said follower being free to slide up and down in said tube;

(d) a magazine spring compressed between said base and said follower, including, (i) a plurality of coils, (ii) each coil in said plurality of coils including a forward region, a left region, a rearward region, and a right region, (iii) a first quantity of said left regions being positioned to nest with other left regions upon compression of said magazine spring, (iv) a second quantity of said right regions being positioned to nest with other right regions upon compression of said magazine spring, (v) wherein said second quantity is less than said first quantity, so that a right side compressed height of said magazine spring is greater than a left side compressed height of said magazine spring;

(e) said follower having an upper portion and a lower portion, said upper portion being configured to bear against said cartridges loaded in said magazine and urge said cartridges upward; and (f) said follower including a downward-opening spring receiver cavity:

(g) an upper portion of said magazine spring resting within said spring receiver cavity; and (h) said greater compressed height of said right side of said magazine spring with respect to said left side of said magazine spring producing a lateral movement of said follower with respect to said spring upon compression of said spring.

2. The magazine as recited in claim 1, wherein said second quantity is at least two less than said first quantity.

3. The magazine as recited in claim 1, wherein said magazine spring further comprises:

(a) a straight portion including a first plurality of coils;

(b) a transition portion including a second plurality of coils; and (c) said second plurality of coils including a plurality of elongated coils having a length and a width, with said length of said elongated coils being over twice said width of said elongated coils.

4. The magazine as recited in claim 1, wherein an upper portion of said magazine spring inclines so that an uppermost forward region of an uppermost coil is above an uppermost rearward region of said uppermost coil upon said spring nearing maximum compression.

5. The magazine as recited in claim 1, wherein:

(a) said follower includes a forward skirt and a rearward skirt;

(b) said spring receiver cavity includes a forward boss proximate said forward skirt;

(c) said spring receiver cavity includes a rearward boss proximate said rearward skirt; and (d) an uppermost coil in said second plurality of coils encircles said forward boss and said rearward boss, thereby creating said tilt-limiting engagement between said spring and said follower.

6. A magazine for feeding a plurality of cartridges into a firearm, comprising:

(a) a tube having a lower end, an upper end, a forward wall, a left wall, a rearward wall, and a right wall;

(b) a base closing said lower end of said tube;

(c) a follower within said tube, said follower being free to slide up and down in said tube;

(d) a magazine spring compressed between said base and said follower, including, (i) a plurality of coils, (ii) each coil in said plurality of coils including a forward region, a left region, a rearward region, and a right region, (iii) wherein said left regions nest to a greater extent than said right regions upon compression of said magazine spring, so that a right side compressed height of said magazine spring is greater than a left side compressed height of said magazine spring;

(e) said follower having an upper portion and a lower portion, said upper portion being configured to bear against said cartridges loaded in said magazine and urge said cartridges upward;

(f) said lower portion of said follower including a downward-opening spring receiver cavity;

(g) an upper portion of said spring resting within said spring receiver cavity and being connected to said follower by a tilt-limiting engagement; and (h) said greater compressed height of said right side of said magazine spring with respect to said left side of said magazine spring producing a lateral movement of said follower with respect to said spring upon compression of said spring.

7. The magazine as recited in claim 6, wherein said left regions nest at least two coils more than said right regions.

8. The magazine as recited in claim 6, wherein said magazine spring further comprises:

(a) a straight portion including a first plurality of coils;

(b) a transition portion including a second plurality of coils; and (c) said second plurality of coils including a plurality of elongated coils having a length and a width, with said length of said elongated coils being over twice said width of said elongated coils.

9. The magazine as recited in claim 6, wherein an upper portion of said magazine spring inclines so that an uppermost forward region of an uppermost coil is above an uppermost rearward region of said uppermost coil upon said spring nearing maximum compression.

10. The magazine as recited in claim 6, wherein: (a) said follower includes a forward skirt and a rearward skirt (b) said spring receiver cavity includes a forward boss proximate said forward skirt; (c) said spring receiver cavity includes a rearward boss proximate said rearward skirt; and (d) an uppermost coilin said second plurality of coils encircles said forward boss and said rearward boss, thereby creating said tilt-limiting engagement between said spring and said follower.

11. A magazine for feeding a plurality of cartridges into a firearm, comprising:

(a) a tube having a lower end and an upper end;

(b) a base closing said lower end of said tube;

(c) a follower within said tube, said follower being free to slide up and down in said tube;

(d) a magazine spring compressed between said base and said follower, including, (i) a plurality of coils, (ii) each coil in said plurality of coils including a forward region, a left region, a rearward region, and a right region, (iii) wherein one of said left or right regions nest to a greater extent than the other of said left or right regions upon compression of said magazine spring, causing a first side compressed height of said magazine spring to be greater than a second side compressed height of said magazine spring;

(e) said follower having an upper portion and a lower portion, said upper portion being configured to bear against said cartridges loaded in said magazine and urge said cartridges upward;

(f) said lower portion of said follower including a spring receiver cavity;

(g) an upper portion of said spring resting within said spring receiver cavity and being connected to said follower by a tilt-limiting engagement; and (h) said greater first side compressed height of said magazine spring with respect to said second side compressed height of said magazine spring producing a lateral movement of said follower with respect to said spring upon compression of said spring.

12. The magazine as recited in claim 11, wherein said second side nests at least two coils more than said first side.

13. The magazine as recited in claim 11, wherein said magazine spring further comprises:

(a) a straight portion including a first plurality of coils;

(b) a transition portion including a second plurality of coils; and (c) said second plurality of coils including a plurality of elongated coils having a length and a width, with said length of said elongated coils being over twice said width of said elongated coils.

14. The magazine as recited in claim 11, wherein an upper portion of said magazine spring inclines so that an uppermost forward region of an uppermost coil is above an uppermost rearward region of said uppermost coil upon said spring nearing maximum compression.

* * * * *